US011574516B2

(12) United States Patent
Sano et al.

(10) Patent No.: US 11,574,516 B2
(45) Date of Patent: Feb. 7, 2023

(54) METHOD, SYSTEM, AND COMPUTER READABLE MEDIUM FOR SETTING DISCRIMINATION CRITERION INFORMATION

(71) Applicant: ASAHI SEIKO CO., LTD., Tokyo (JP)

(72) Inventors: Koji Sano, Saitama (JP); Hiroshi Banno, Saitama (JP); Hiroshi Ohtomo, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 303 days.

(21) Appl. No.: 16/796,235

(22) Filed: Feb. 20, 2020

(65) Prior Publication Data

US 2020/0302723 A1 Sep. 24, 2020

(30) Foreign Application Priority Data

Mar. 22, 2019 (JP) ..... JP2019-055724

(51) Int. Cl.
*G07D 5/02* (2006.01)
*G07D 11/22* (2019.01)
(Continued)

(52) U.S. Cl.
CPC ..... *G07D 5/02* (2013.01); *G07D 5/08* (2013.01); *G07D 11/22* (2019.01); *G07D 11/28* (2019.01);
(Continued)

(58) Field of Classification Search
CPC .... G07D 5/02; G07D 11/22; G07D 2205/001; G07D 5/08; G07D 11/28; G07D 11/13;
(Continued)

(56) References Cited

U.S. PATENT DOCUMENTS 5,067,604 A 11/1991 Metcalf
6,731,785 B1 * 5/2004 Mennie ..... G07D 7/121 434/110
(Continued)

FOREIGN PATENT DOCUMENTS

EP 1324278 A1 7/2003
EP 1324279 A1 7/2003
(Continued)

OTHER PUBLICATIONS

Oct. 26, 2021 Japanese Office Action in counterpart Japanese patent application No. 2020-051560 and partial English translation thereof.
(Continued)

*Primary Examiner* — Jeffrey A Shapiro
(74) *Attorney, Agent, or Firm* — Greenblum & Bernstein, P.L.C.

(57) ABSTRACT

A method for setting discrimination criterion information pieces for one or more additional denominations in a coin discrimination apparatus is provided, which eliminates the task of visiting the installation location of an existing coin discrimination apparatus to exchange this apparatus for a new one including discrimination criterion information pieces for one or more additional denominations and the task of setting discrimination criterion information pieces for the one or more additional denominations manually in the apparatus. A target denomination is designated from current denominations whose discrimination criterion information pieces are stored in a coin discrimination apparatus. Then, discrimination criterion information pieces for an additional denomination are calculated based on discrimination criterion information pieces for the target denomination, target denomination standard information pieces corresponding to the discrimination criterion information pieces for the target denomination, and additional denomination standard infor-
(Continued)

mation pieces corresponding to the discrimination criterion information pieces for the additional denomination.

25 Claims, 15 Drawing Sheets

(51) Int. Cl.
*G07D 5/08* (2006.01)
*G07D 11/28* (2019.01)

(52) U.S. Cl.
CPC ..... *G07D 2205/001* (2013.01); *G07D 2205/0012* (2013.01)

(58) Field of Classification Search
CPC ..... G07D 11/14; G07D 11/165; G07D 11/18; G07D 11/50; G07D 7/16; G07D 2205/00; G07D 7/2075; G07D 7/2083; G07D 7/2091
See application file for complete search history.

(56) References Cited

U.S. PATENT DOCUMENTS 6,830,143 B2 12/2004 King
7,198,157 B2 * 4/2007 King ..... G07D 5/00 209/552
8,720,664 B2 * 5/2014 Anouar ..... G07D 7/121 194/207
9,424,703 B2 * 8/2016 Baudat ..... G07D 5/08
9,704,323 B2 7/2017 Ohtomo
2003/0121755 A1 * 7/2003 King ..... G07D 5/00 194/302
2003/0136629 A1 * 7/2003 King ..... G07D 5/00 194/302
2011/0016965 A1 1/2011 Sasaki
2011/0184697 A1 * 7/2011 Tada ..... G07D 5/02 702/173
2013/0199889 A1 * 8/2013 Anouar ..... G07D 7/121 194/207
2015/0287259 A1 * 10/2015 Baudat ..... G07D 5/08 194/302

FOREIGN PATENT DOCUMENTS

JP 8-273019 10/1996
JP 4226315 B2 2/2009
JP 2015-97001 A 5/2015
JP 2016-115172 A 6/2016
WO 99/49423 A1 9/1999

OTHER PUBLICATIONS

Jan. 12, 2021 Taiwanese Office Action in Taiwanese Application No. 109105591 and English translation thereof.
Aug. 12, 2021 GCC (Gulf Cooperation Council) Examination Report in corresponding Gulf Cooperation Council Patent Application No. 2020-39409 and English translation thereof.
Jul. 17, 2020 Extended European Search Report in European Application No. 20162694.2.
Sep. 24, 2021 Chinese Office Action issued in Chinese Office Action No. 202010157348.7 and concise explanation of the relevance thereof.

* cited by examiner

OPERATION FLOW OF DISCRIMINATION CRITERION INFORMATION SETTING SYSTEM

OPERATION FLOW OF
ORDINARY COIN DISCRIMINATION
(NORMAL MODE)

FIG. 14

| | DISCRIMINATION CRITERION INFORMATION PIECES | | | | | | | |
|---|---|---|---|---|---|---|---|---|
| DENOMI-NATION NO. | Pa | Pb | Pc | Pd | Pe | Pf | ... | Px |
| 1 | 1Pa | 1Pb | 1Pc | 1Pd | 1Pe | 1Pf | ... | 1Px |
| 2 | 2Pa | 2Pb | 2Pc | 2Pd | 2Pe | 2Pf | ... | 2Px |
| 3 | 3Pa | 3Pb | 3Pc | 3Pd | 3Pe | 3Pf | ... | 3Px |
| 4 | 4Pa | 4Pb | 4Pc | 4Pd | 4Pe | 4Pf | ... | 4Px |
| 5 | 5Pa | 5Pb | 5Pc | 5Pd | 5Pe | 5Pf | ... | 5Px |
| 6 | UNREGIS-TERED | UNREGIS-TERED | UNREGIS-TERED | UNREGIS-TERED | UNREGIS-TERED | UNREGIS-TERED | ... | UNREGIS-TERED |
| 7 | UNREGIS-TERED | UNREGIS-TERED | UNREGIS-TERED | UNREGIS-TERED | UNREGIS-TERED | UNREGIS-TERED | ... | UNREGIS-TERED |
| 8 | UNREGIS-TERED | UNREGIS-TERED | UNREGIS-TERED | UNREGIS-TERED | UNREGIS-TERED | UNREGIS-TERED | ... | UNREGIS-TERED |
| ... | ... | ... | ... | ... | ... | ... | ... | ... |
| k | UNREGIS-TERED | UNREGIS-TERED | UNREGIS-TERED | UNREGIS-TERED | UNREGIS-TERED | UNREGIS-TERED | | UNREGIS-TERED |

FIG. 15

| | PARAMETER INFORMATION PIECES ASSIGNED TO RESPECTIVE DISCRIMINATION CRITERION INFORMATION PIECES | | | | | | | | |
|---|---|---|---|---|---|---|---|---|---|
| DENOMI-NATION No. | Pa | Pb | Pc | Pd | Pe | Pf | ··· | Px | |
| 6 | 1Pa | 3Pb | 1Pc | 3Pd | 1Pe | 1Pf | ··· | 1Px | ← Ak1 |
| | 2Pa | 4Pb | 2Pc | 4Pd | 3Pe | 2Pf | ··· | 2Px | ← Ak2 |
| | xxx | xxx | xxx | xxx | xxx | xxx | ··· | xxx | ← Ax_0/Ak1_0 |
| | xxx | xxx | xxx | xxx | xxx | xxx | ··· | xxx | ← V1/V2 |
| | xxx | xxx | xxx | xxx | xxx | xxx | ··· | xxx | ← V3/V4 |
| 7 | 3Pa | 1Pb | 3Pc | 1Pd | 2Pe | 3Pf | ··· | 3Px | ← Ak1 |
| | 4Pa | 2Pb | 4Pc | 2Pd | 4Pe | 4Pf | ··· | 4Px | ← Ak2 |
| | xxx | xxx | xxx | xxx | xxx | xxx | ··· | xxx | ← Ax_0/Ak1_0 |
| | xxx | xxx | xxx | xxx | xxx | xxx | ··· | xxx | ← V1/V2 |
| | xxx | xxx | xxx | xxx | xxx | xxx | ··· | xxx | ← V3/V4 |

METHOD, SYSTEM, AND COMPUTER READABLE MEDIUM FOR SETTING DISCRIMINATION CRITERION INFORMATION

BACKGROUND OF THE INVENTION

1. Field of the Invention

The present invention relates to setting discrimination criterion information pieces in a coin discrimination apparatus. More particularly, the present invention relates to a method, a system, and a computer readable medium for setting discrimination criterion information pieces for one or more additional denominations in addition to discrimination criterion information pieces for current denominations that are prepared for discriminating the denomination and authenticity of coins in a coin discrimination apparatus.

In this specification, the term "coin" has a wide meaning that includes not only coins as currency but also coin equivalents such as tokens and medals other than coins as currency, in which the shape of a "coin" is not limited to a circular one and may be a polygonal or any other one.

2. Description of the Related Art

Conventionally, coin depositing/dispensing apparatuses for automatically conducting the depositing and dispensing processes of coins have been known, as disclosed in, for example, Japanese Unexamined Patent Publication No. 2015-097001 issued on May 21, 2015. Coin depositing/dispensing apparatuses of this type are usually configured to do the following actions: Specifically, coins thrown into a coin inlet are separated from each other by a coin separating and delivering section, and the denomination and authenticity of the coins are discriminated by a coin discriminating section. Then, the coins thus discriminated are conveyed individually and distributed into their respective denominations to be stored in a coin storing section by a coin conveying section. Furthermore, designated denominations and designated numbers of the coins are selected and taken out of those stored in the coin storing section according to a predetermined dispensing signal (e.g., a dispensing signal for change) and then, dispensed into a coin outlet by a coin dispensing section.

In the coin discriminating section of the aforementioned conventional coin depositing/dispensing apparatus, not only the denomination of the coins but also the authentication thereof are discriminated, in which a coin discrimination apparatus having a plurality of coin sensors is used for these two types of discrimination. A configuration of such the coin discrimination apparatus is disclosed in, for example, Japanese Unexamined Patent Publication No. 2016-115172 issued on Jun. 23, 2016. The coin discrimination apparatus of this type is configured so as to discriminate the denomination and authenticity of the respective coins with high accuracy. However, after the installation (i.e., the commencement of use) of the coin discrimination apparatus, there arises a situation where the count of the discriminable denominations of coins is desired to be increased, in other words, the existing range of the discriminable denominations is desired to be expanded in such a way that a previously-issued denomination which is not included in the existing discriminable range and/or a newly-issued denomination can be additionally discriminated. The denomination to be added in this way may be termed an "additional denomination" hereinafter. In this situation, it is necessary to update the control program (i.e., the coin discrimination program) installed into the existing coin discrimination apparatus to a new one. This control program may be referred to as the "control firmware" or the "coin discrimination firmware" hereinafter.

To conduct the aforementioned update operation of the control firmware (i.e., the coin discrimination program), conventionally, a service engineer in charge visits the installation location of an existing coin depositing/dispensing apparatus and then, exchanges the existing coin discrimination apparatus built in this coin depositing/dispensing apparatus for a new coin discrimination apparatus in which a new control firmware (i.e., a new coin discrimination program) has been installed. Alternatively, a service engineer in charge manually updates (i.e., overwrite installs) the control firmware which has been already installed in the existing coin discrimination apparatus and furthermore, conducts the teaching operation. Since the cost for exchanging the coin discrimination apparatus itself is high, it is usual that the manually updating of the control firmware and the teaching are chosen. Such the manually updating and teaching operations of the control firmware is carried out, for example, in the following way:

Specifically, first, a service engineer in charge prepares a new control firmware, a personal computer (which may be referred to as "PC" hereinafter), an application for update, and a predetermined number of coins having the aforementioned additional denomination (usually, 30 coins for each additional denomination) and then, he/she carries these things thus prepared to visit the installation location of an existing coin depositing/dispensing apparatus. Following this, he/she connects his/her own PC to the existing coin depositing/dispensing apparatus, thereby enabling communication between the PC and the coin depositing/dispensing apparatus concerned. Thereafter, he/she manipulates the updating application installed in his/her PC to update the current control firmware installed in the non-volatile storage device that has been built in the coin discrimination apparatus of this coin depositing/dispensing apparatus using the new control firmware thus carried. Subsequently, he/she manipulates the updating application on his/her PC to change the operation mode of the said coin depositing/dispensing apparatus from the normal mode to the teaching mode. In this state, he/she throws the predetermined number of coins of the additional denomination, which have been carried by him/her, into the coin depositing/dispensing apparatus in question one by one, thereby obtaining output signals emitted from the coin sensors built in the said coin discrimination apparatus. Then, due to the operation of the updating application on his/her PC, voltage values (which may be termed "specific values" hereinafter) corresponding to the predetermined discrimination criterion values are acquired based on the waveform signals generated from the output signals thus obtained, and the voltage values (i.e., specific values) thus acquired are stored in the non-volatile storage device of the said coin discrimination apparatus.

The aforementioned process from the throwing of the coins of the additional denomination to the acquisition and storing of the specific values as the new discrimination criterion information pieces is repeatedly conducted by the updating application for the respective additional denominations. This means that the repeat count of this process is equal to the total number of the coins (usually, 30 coins for each additional denomination). Finally, due to the operation of the updating application, the specific values that have been obtained for the additional denomination are averaged and stored in the aforementioned non-volatile storage device as the discrimination criterion information pieces for the additional denomination. In this way, the setting operation of the discrimination criterion information pieces for the additional denomination is finally completed. In case where two or more additional denominations need to be simultaneously added, the aforementioned process is repeated a plurality of times which correspond to the count of the two or more additional denominations. Subsequently, the service engineer manipulates the updating application on his/her PC again to change the operation mode of the coin depositing/dispensing apparatus concerned to the normal mode from the teaching mode. After that, this coin depositing/dispensing apparatus conducts its ordinary coin discrimination operation while using both of the newly added discrimination criterion information pieces and the current or existing discrimination criterion information pieces. In this way, the discriminable range of denomination of the existing coin depositing/dispensing apparatus can be expanded.

As explained above, there is a problem that the aforementioned firmware updating operation and the aforementioned teaching operation are not only troublesome but also form a factor that raises the service cost. The aforementioned updating and teaching operations can be carried out by the user of the coin depositing/dispensing apparatus; however, these operations are troublesome and therefore, there arises a high tendency for the uses to have dissatisfaction with the coin depositing/dispensing apparatus. Moreover, this problem will become a big one in the case where the aforementioned firmware updating operation is unable to be carried out in an existing coin depositing/dispensing apparatus. For this reason, there is the need to accomplish the reduction of burden of a service engineer in charge by simplifying and labor-saving the aforementioned updating and teaching operations in some way.

A relevant technique usable for responding the above need is disclosed in, for example, Japanese Examined Patent Publication No. 4226315 issued on Dec. 5, 2008. This Japanese Patent Publication discloses a calibration method of a coin inspection apparatus, in which articles (e.g., coins) that belong to known calibration classes are supplied to a coin receiver in an arbitrary order to obtain measured values for calibration. Regarding the coins for calibration, preferably, measured values are normalized using other measured values as the normalization coefficients and then, the Mahalanobis distance is calculated using the measured values thus normalized, thereby classifying the coins for calibration. Moreover, in the case where the completeness check suggests that the measured values have no reliability, the measured values are not used for calibration. In this Publication, it is said that calibration of the coin receiver can be carried out more quickly and more easily than the prior art in this method.

However, the aforementioned calibration method of a coin inspection apparatus disclosed in the aforementioned Publication No. 4226315 is used for "calibration" in order to suppress the dispersion or variation of the inspection performance (i.e., coin discrimination performance) of a coin inspection apparatus. Furthermore, this calibration method does not relate to the addition of new discrimination criterion information pieces to the current or existing discrimination criterion information pieces. Thus, it is not easy for this method to be applied to the aforementioned firmware updating operation.

SUMMARY OF THE INVENTION

The present invention was created to fulfill the aforementioned need to accomplish the reduction of burden of a service engineer in charge of the aforementioned firmware updating operation while taking the aforementioned situations into consideration.

Accordingly, an object of the present invention is to provide a method, a system, and a computer readable medium for setting discrimination criterion information pieces in a coin discrimination apparatus that make it possible to eliminate the task of visiting the installation location of an existing coin discrimination apparatus to exchange the said apparatus for a new one that includes discrimination criterion information pieces for one or more additional denominations and the task of setting discrimination criterion information pieces for one or more additional denominations manually in an existing coin discrimination apparatus.

Another object of the present invention is to provide a method, a system, and a computer readable medium for setting discrimination criterion information pieces in a coin discrimination apparatus that make it possible to setting discrimination criterion information pieces for one or more additional denominations by simply conducting an updating operation of a control program or a control firmware that is incorporated in an existing coin discrimination apparatus.

Still another object of the present invention is to provide a method, a system, and a computer readable medium for setting discrimination criterion information pieces in a coin discrimination apparatus that make it possible to reduce the discrimination error which is caused by an individual difference in coin discrimination performance of an existing coin discrimination apparatus.

A further object of the present invention is to provide a method, a system, and a computer readable medium for setting discrimination criterion information pieces in a coin discrimination apparatus that make it possible to conduct an updating operation of a control program or a control firmware that is incorporated in an existing coin discrimination apparatus even if a storage or memory device of the existing coin discrimination apparatus does not have a sufficient storing capacity for conducting the aforementioned updating operation of the control program or firmware.

The above objects together with others not specifically mentioned here will become clear to those skilled in the art from the following description.

According to a first aspect of the present invention, a method for setting discrimination criterion information pieces for an additional denomination in addition to discrimination criterion information pieces for each of current denominations in a coin discrimination apparatus that conducts authenticity discrimination and denomination discrimination of coins using sensor information pieces outputted from coin sensors is provided, the method comprising:

judging whether or not the discrimination criterion information pieces for the additional denomination are stored in a discrimination criterion information storing device of the coin discrimination apparatus in which the discrimination criterion information pieces for each of the current denominations are stored;

designating a target denomination from the current denominations when it is judged that the discrimination criterion information pieces for the additional denomination are not stored;

calculating the discrimination criterion information pieces for the additional denomination based on discrimination criterion information pieces for the target denomination, target denomination standard information pieces corresponding to the discrimination criterion information pieces for the target denomination, and additional denomination standard information pieces corresponding to the discrimination criterion information pieces for the additional denomination;

storing the calculated discrimination criterion information pieces for the additional denomination in the discrimination criterion information storing device; and setting the coin discrimination apparatus to conduct authentication discrimination and denomination discrimination using the calculated discrimination criterion information pieces for the additional denomination.

With the method according to the first aspect of the present invention, as explained above, the discrimination criterion information pieces for the additional denomination are calculated based on the discrimination criterion information pieces for the target denomination which are designated from the current denominations, the target denomination standard information pieces corresponding to the discrimination criterion information pieces for the target denomination, and the additional denomination standard information pieces corresponding to the discrimination criterion information pieces for the additional denomination.

Here, the target denomination standard information pieces are standard information pieces that are set for the target denomination, i.e., the designated one of the current denominations, where the current denominations are denominations to be discriminated currently. Here, the meaning of "standard information" is information used as a "standard" to comply with when setting the discrimination criterion information pieces for the current denomination designated as the target denomination using a "standard apparatus" which is prepared for the coin discrimination apparatus by its manufacturing enterprise. The target denomination standard information pieces can be easily obtained by conducting the authenticity discrimination and denomination discrimination of coins having the target denomination using the "standard apparatus".

Similarly, the additional denomination standard information pieces are standard information pieces that are set for the additional denomination to be added to the current denominations. The meaning of "standard information" is information used as a "standard" to comply with when setting the discrimination criterion information pieces for the additional denomination using the aforementioned "standard apparatus". The additional denomination standard information pieces can be easily obtained by conducting the authenticity discrimination and denomination discrimination of coins having the additional denomination using the aforementioned "standard apparatus".

Moreover, there is an analogy that the relationship between the target denomination standard information pieces and the additional denomination standard information pieces in the standard apparatus is kept in the coin discrimination apparatus which is produced in quantity and practically operated. Taking this analogy into consideration, by knowing the relationship between the target denomination standard information pieces and the additional denomination standard information pieces, the discrimination criterion information pieces for the additional denomination can be obtained using the discrimination criterion information pieces for the target denomination and the said relationship.

In addition, when designating the target denomination, it is preferred to select one or more from the current denominations in such a way that the obtainable discrimination criterion information pieces are more preferred.

As described above, with the method according to the first aspect of the present invention, the discrimination criterion information pieces for the additional denomination can be obtained by the calculation operation using the discrimination criterion information pieces for the target denomination and the relationship between the target denomination standard information pieces and the additional denomination standard information pieces and then, the discrimination criterion information pieces for the additional denomination thus obtained are stored in the discrimination criterion information storing device of the coin discrimination apparatus and furthermore, the said apparatus is set to conduct authentication discrimination and denomination discrimination using the stored discrimination criterion information pieces for the additional denomination.

Accordingly, the task of visiting the installation location of an existing coin discrimination apparatus to exchange the said apparatus for a new one that includes discrimination criterion information pieces for one or more additional denominations and the task of setting discrimination criterion information pieces for one or more additional denominations manually in an existing coin discrimination apparatus can be eliminated. This means that the discrimination criterion information pieces for one or more additional denominations can be set by simply conducting an updating operation of a control program or firmware that is incorporated in an existing coin discrimination apparatus.

Furthermore, the discrimination error caused by an individual difference in coin discrimination performance of an existing coin discrimination apparatus can be reduced by appropriately designating the target denomination from the current denominations.

In a preferred embodiment of the method according to the first aspect of the present invention, it is judged whether or not two or more of the target denominations can be designated from the current denominations, and when two or more of the target denominations can be designated from the current denominations, the two or more of the target denominations are selectively used in such a way that differences in value between the target denomination standard information pieces for each of the two or more of the target denominations and the corresponding additional denomination standard information pieces are as small as possible.

In this embodiment, the deviations or errors of the discrimination criterion information pieces for the additional denomination from the corresponding discrimination criterion information pieces for the two or more of the target denominations, which are caused by the fact that the differences in value between the target denomination standard information pieces and the corresponding additional denomination standard information pieces are large, can be reduced. Accordingly, there is an additional advantage that the discrimination error with respect to the additional denomination caused by an individual difference in coin discrimination performance of the coin discrimination apparatus can be reduced.

In another preferred embodiment of the method according to the first aspect of the present invention, two or more of the target denominations are designated from the current denominations; and the target denomination standard information pieces for each of the two or more of the target denominations are used for calculating the discrimination criterion information pieces for the additional denomination.

In this embodiment, since the discrimination criterion information pieces for the two or more of the target denominations are included in the discrimination criterion information pieces for the additional denomination during the calculation operation of the discrimination criterion information pieces for the additional denomination, there is an additional advantage that the discrimination error with respect to the additional denomination caused by an individual difference in coin discrimination performance of the coin discrimination apparatus can be reduced compared with the case where the discrimination criterion information pieces for the single target denomination are included, by selectively using the two or more of the target denominations in such a way that differences in value between the target denomination standard information pieces and the corresponding additional denomination standard information pieces are as small as possible, for example.

In still another preferred embodiment of the method according to the first aspect of the present invention, in a case where it is required to set the discrimination criterion information pieces for two or more of the additional denominations at one time, two or more of the target denominations are switchably designated when calculating the discrimination criterion information pieces for each of the two or more of the additional denominations.

In this embodiment, there is an additional advantage that this method can cope with a request for setting the discrimination criterion information pieces for two or more of the additional denominations at one time.

In a further preferred embodiment of the method according to the first aspect of the present invention, ratios between the target denomination standard information pieces corresponding to the discrimination criterion information pieces for the target denomination and the additional denomination standard information pieces corresponding to the discrimination criterion information pieces for the additional denomination are calculated and stored in the coin discrimination apparatus in advance; and the discrimination criterion information pieces for the additional denomination are calculated using the ratios.

In this embodiment, there is an additional advantage that the calculation for obtaining the discrimination criterion information pieces for the additional denomination is simplified.

In a further preferred embodiment of the method according to the first aspect of the present invention, when the discrimination criterion information pieces for the additional denomination are calculated, the target denomination standard information pieces which have been obtained by executing the coin discrimination of the target denomination in a standard apparatus of the coin discrimination apparatus and the additional denomination standard information pieces which have been obtained by executing the coin discrimination of the additional denomination in the standard apparatus are used.

In this embodiment, there is an additional advantage that the target denomination standard information pieces and the additional denomination standard information pieces are credible and easily obtainable.

In a further preferred embodiment of the method according to the first aspect of the present invention, (a) a function of storing the target denomination standard information pieces and the additional denomination standard information pieces in the coin discrimination apparatus using the target denomination which is designated in advance, (b) a function of calculating the discrimination criterion information pieces for the additional denomination based on the discrimination criterion information pieces for the target denomination, the target denomination standard information pieces, and the additional denomination standard information pieces, (c) a function of storing the calculated discrimination criterion information pieces for the additional denomination in the discrimination criterion information storing device, and (d) a function of setting the coin discrimination apparatus to conduct authentication discrimination and denomination discrimination using the calculated discrimination criterion information pieces for the additional denomination are realized by single software (e.g., a discrimination criterion information setting system 100).

In this embodiment, there is an additional advantage that the updating operation of the control program or firmware can be conducted even if the storage or memory device of the coin discrimination apparatus into which the control program or firmware is incorporated does not have a sufficient storing capacity for conducting the aforementioned updating operation.

In a further preferred embodiment of the method according to the first aspect of the present invention, the discrimination criterion information pieces for the target denomination are given by amplitudes of a first set of waveforms that vary according to the sensor information pieces;

the discrimination criterion information pieces for the additional denomination are given by amplitudes of a second set of waveforms that vary according to the sensor information pieces;

the target denomination standard information pieces are given by amplitudes of a third set of waveforms that vary according to the sensor information pieces;

the additional denomination standard information pieces are given by amplitudes of a fourth set of waveforms that vary according to the sensor information pieces; and a relationship between the amplitudes that give the discrimination criterion information pieces for the target denomination and the amplitudes that give the discrimination criterion information pieces for the additional denomination is given by a relationship between the target denomination standard information pieces and the additional denomination standard information pieces.

In a further preferred embodiment of the method according to the first aspect of the present invention, the discrimination criterion information pieces for the additional denomination include an information item relating to a material of the coins, an information item relating to a thickness of the coins, and an information item relating to a diameter of the coins; and when the information item relating to the diameter of the coins is calculated, one of the current denominations that has a nearest diameter to the additional denomination is designated as the target denomination.

In this embodiment, since one of the current denominations that has a nearest diameter to the additional denomination is designated as the target denomination, the errors between the target denomination standard information pieces and the additional denomination standard information pieces can be surely reduced. Accordingly, there is an additional advantage that the discrimination error with respect to the additional denomination which is caused by an individual difference in coin discrimination performance of the coin discrimination apparatus can be surely reduced.

In a further preferred embodiment of the method according to the first aspect of the present invention, when the discrimination criterion information pieces for the additional denomination are calculated based on the discrimination criterion information pieces for the target denomination, the target denomination standard information pieces corresponding to the discrimination criterion information pieces for the target denomination, and the additional denomination standard information pieces corresponding to the discrimination criterion information pieces for the additional denomination, two or more calculation methods using predetermined parameter information pieces can be selectively used; and one of the two or more calculation methods is selectively used in such a way as to reduce an effect of fluctuation due to an individual difference of the coin discrimination apparatus.

In this embodiment, there is an additional advantage that the effect of fluctuation due to an individual difference of the coin discrimination apparatus can be surely reduced.

According to a second aspect of the present invention, a system for setting discrimination criterion information pieces for an additional denomination in addition to discrimination criterion information pieces for each of current denominations in a coin discrimination apparatus that conducts authenticity discrimination and denomination discrimination of coins using sensor information pieces outputted from coin sensors is provided, the system comprising:

a state judging unit or controller that is configured to judge whether or not the discrimination criterion information pieces for the additional denomination are stored in a discrimination criterion information storing device of the coin discrimination apparatus in which the discrimination criterion information pieces for each of the current denominations are stored (e.g., a state judging section or controller 101);

a target denomination designating unit or controller that is configured to designate a target denomination from the current denominations when it is judged that the discrimination criterion information pieces for the additional denomination are not stored (e.g., a target denomination designating section or controller 102);

an additional denomination discrimination criterion information calculating unit or controller that is configured to calculate the discrimination criterion information pieces for the additional denomination based on discrimination criterion information pieces for the target denomination, target denomination standard information pieces corresponding to the discrimination criterion information pieces for the target denomination, and additional denomination standard information pieces corresponding to the discrimination criterion information pieces for the additional denomination (e.g., an additional denomination discrimination criterion information calculating section or controller 103);

an additional denomination discrimination criterion information storing unit or controller that is configured to store the calculated discrimination criterion information pieces for the additional denomination in the discrimination criterion information storing device (e.g., an additional denomination discrimination criterion information calculating section or controller 103); and an additional denomination discrimination criterion information stetting unit or controller that is configured to set the coin discrimination apparatus to conduct authentication discrimination and denomination discrimination using the calculated discrimination criterion information pieces for the additional denomination (e.g., an additional denomination discrimination criterion information setting section or controller 104).

With the system according to the second aspect of the present invention, as explained above, the discrimination criterion information pieces for the additional denomination are calculated based on the discrimination criterion information pieces for the target denomination which are designated from the current denominations, the target denomination standard information pieces corresponding to the discrimination criterion information pieces for the target denomination, and the additional denomination standard information pieces corresponding to the discrimination criterion information pieces for the additional denomination. This calculation is carried out by the additional denomination discrimination criterion information calculating unit or controller.

As described above with respect to the method according to the first aspect of the present invention, the target denomination standard information pieces are standard information pieces that are set for the target denomination, i.e., the designated one of the current denominations, where the current denominations are denominations to be discriminated currently, and the additional denomination standard information pieces are standard information pieces that are set for the additional denomination to be added to the current denominations. The meaning of "standard information" in the target denomination standard information and the additional denomination standard information is the same as that described above about the method according to the first aspect of the present invention.

Moreover, similar to the method according to the first aspect of the present invention, there is an analogy that the relationship between the target denomination standard information pieces and the additional denomination standard information pieces in the standard apparatus is kept in the coin discrimination apparatus which is produced in quantity and practically operated. Taking this analogy into consideration, by knowing the relationship between the target denomination standard information pieces and the additional denomination standard information pieces, the discrimination criterion information pieces for the additional denomination can be obtained using the discrimination criterion information pieces for the target denomination.

In addition, when designating the target denomination by the target denomination designating unit or controller, it is preferred to select one or more from the current denominations in such a way that the obtainable discrimination criterion information pieces are more preferred.

As described above, with the system according to the second aspect of the present invention, the discrimination criterion information pieces for the additional denomination can be obtained by the calculation operation using the discrimination criterion information pieces for the target denomination, and the relationship between the target denomination standard information pieces and the additional denomination standard information pieces and then, the discrimination criterion information pieces for the additional denomination thus obtained are stored in the discrimination criterion information storing device of the coin discrimination apparatus and furthermore, the said apparatus is set to conduct authentication discrimination and denomination discrimination using the stored discrimination criterion information pieces for the additional denomination.

Accordingly, the task of visiting the installation location of an existing coin discrimination apparatus to exchange the said apparatus for a new one that includes discrimination criterion information pieces for one or more additional denominations and the task of setting discrimination criterion information pieces for one or more additional denominations manually in an existing coin discrimination apparatus can be eliminated. This means that the discrimination criterion information pieces for one or more additional denominations can be set by simply conducting an updating operation of a control program or firmware that is incorporated in an existing coin discrimination apparatus.

Furthermore, the discrimination error caused by an individual difference in coin discrimination performance of an existing coin discrimination apparatus can be reduced by appropriately designating the target denomination from the current denomination.

In a preferred embodiment of the system according to the second aspect of the present invention, the target denomination designating unit or controller has a configuration that two or more of the target denominations can be designated from the current denominations, and when two or more of the target denominations are designated from the current denominations, the two or more of the target denominations are selectively used in such a way that differences in value between the target denomination standard information pieces for each of the two or more of the target denominations and the corresponding additional denomination standard information pieces are as small as possible in the additional denomination discrimination criterion information calculating unit or controller.

In this embodiment, the deviations or errors of the discrimination criterion information pieces for the additional denomination from the corresponding discrimination criterion information pieces for the two or more of the target denominations, which are caused by the fact that the differences in value between the target denomination standard information pieces and the corresponding additional denomination standard information pieces are large, can be reduced. Accordingly, there is an additional advantage that the discrimination error with respect to the additional denomination caused by an individual difference in coin discrimination performance of the coin discrimination apparatus can be reduced.

In another preferred embodiment of the system according to the second aspect of the present invention, two or more of the target denominations are designated from the current denominations in the target denomination designating unit or controller; and the target denomination standard information pieces for each of the two or more of the target denominations are used for calculating the discrimination criterion information pieces for the additional denomination in the additional denomination discrimination criterion information calculating unit or controller.

In this embodiment, since the discrimination criterion information pieces for the two or more of the target denominations are included in the discrimination criterion information pieces for the additional denomination during the calculation operation of the discrimination criterion information pieces for the additional denomination, there is an additional advantage that the discrimination error with respect to the additional denomination caused by an individual difference in coin discrimination performance of the coin discrimination apparatus can be reduced compared with the case where the discrimination criterion information pieces for the single target denomination are included, by selectively using the two or more of the target denominations in such a way that differences in value between the target denomination standard information pieces and the corresponding additional denomination standard information pieces are as small as possible, for example.

In still another preferred embodiment of the system according to the second aspect of the present invention, in a case where it is required to set the discrimination criterion information pieces for two or more of the additional denominations at one time, two or more of the target denominations are switchably designated when calculating the discrimination criterion information pieces for each of the two or more of the additional denominations in the additional denomination discrimination criterion information calculating unit or controller.

In this embodiment, there is an additional advantage that this system can cope with a request for setting the discrimination criterion information pieces for two or more of the additional denominations at one time.

In a further preferred embodiment of the system according to the second aspect of the present invention, ratios between the target denomination standard information pieces corresponding to the discrimination criterion information pieces for the target denomination and the additional denomination standard information pieces corresponding to the discrimination criterion information pieces for the additional denomination are calculated and stored in the coin discrimination apparatus in advance; and the discrimination criterion information pieces for the additional denomination are calculated using the ratios in the additional denomination discrimination criterion information calculating unit or controller.

In this embodiment, there is an additional advantage that the calculation for obtaining the discrimination criterion information pieces for the additional denomination is simplified.

In a further preferred embodiment of the system according to the second aspect of the present invention, when the discrimination criterion information pieces for the additional denomination are calculated, the target denomination standard information pieces which have been obtained by executing the coin discrimination of the target denomination in a standard apparatus of the coin discrimination apparatus and the additional denomination standard information pieces which have been obtained by executing the coin discrimination of the additional denomination in the standard apparatus are used.

In this embodiment, there is an additional advantage that the target denomination standard information pieces and the additional denomination standard information pieces are credible and easily obtainable.

In a further preferred embodiment of the system according to the second aspect of the present invention, (a) a function of storing the target denomination standard information pieces and the additional denomination standard information pieces in the coin discrimination apparatus using the target denomination which is designated in advance, (b) a function of calculating the discrimination criterion information pieces for the additional denomination based on the discrimination criterion information pieces for the target denomination, the target denomination standard information pieces, and the additional denomination standard information pieces, (c) a function of storing the calculated discrimination criterion information pieces for the additional denomination in the discrimination criterion information storing device, and (d) a function of setting the coin discrimination apparatus to conduct authentication discrimination and denomination discrimination using the calculated discrimination criterion information pieces for the additional denomination are realized by single software (e.g., a discrimination criterion information setting system 100).

In this embodiment, there is an additional advantage that the updating operation of the control program or firmware can be conducted even if the storage or memory device of the coin discrimination apparatus into which the control program or firmware is incorporated does not have a sufficient storing capacity for conducting the aforementioned updating operation.

In a further preferred embodiment of the system according to the second aspect of the present invention, the discrimination criterion information pieces for the target denomination are given by amplitudes of a first set of waveforms that vary according to the sensor information pieces;

the discrimination criterion information pieces for the additional denomination are given by amplitudes of a second set of waveforms that vary according to the sensor information pieces;

the target denomination standard information pieces are given by amplitudes of a third set of waveforms that vary according to the sensor information pieces;

the additional denomination standard information pieces are given by amplitudes of a fourth set of waveforms that vary according to the sensor information pieces; and a relationship between the amplitudes that give the discrimination criterion information pieces for the target denomination and the amplitudes that give the discrimination criterion information pieces for the additional denomination is given by a relationship between the target denomination standard information pieces and the additional denomination standard information pieces.

In a further preferred embodiment of the system according to the second aspect of the present invention, the discrimination criterion information pieces for the additional denomination include an information item relating to a material of the coins, an information item relating to a thickness of the coins, and an information item relating to a diameter of the coins; and when the information item relating to the diameter of the coins is calculated, one of the current denominations that has a nearest diameter to the additional denomination is designated as the target denomination in the target denomination designating unit or controller.

In this embodiment, since one of the current denominations that has a nearest diameter to the additional denomination is designated as the target denomination, the errors between the p target denomination standard information pieces and the additional denomination standard information pieces can be surely reduced. Accordingly, there is an additional advantage that the discrimination error with respect to the additional denomination which is caused by an individual difference in coin discrimination performance of the coin discrimination apparatus can be surely reduced.

In a further preferred embodiment of the system according to the second aspect of the present invention, when the discrimination criterion information pieces for the additional denomination are calculated based on the discrimination criterion information pieces for the target denomination, the target denomination standard information pieces corresponding to the discrimination criterion information pieces for the target denomination, and the additional denomination standard information pieces corresponding to the discrimination criterion information pieces for the additional denomination, two or more calculation methods using predetermined parameter information pieces can be selectively used in the additional denomination discrimination criterion information calculating unit or controller; and one of the two or more calculation methods is selectively used in such a way as to reduce an effect of fluctuation due to an individual difference of the coin discrimination apparatus.

In this embodiment, there is an additional advantage that the effect of fluctuation due to an individual difference of the coin discrimination apparatus can be surely reduced.

According to a third aspect of the present invention, a non-transitory computer readable medium storing a program for setting discrimination criterion information pieces for an additional denomination in addition to discrimination criterion information pieces for each of current denominations in a coin discrimination apparatus that conducts authenticity discrimination and denomination discrimination of coins using sensor information pieces outputted from coin sensors, which comprises processes to be executed by a computer, is provided, the processes comprises:

judging whether or not the discrimination criterion information pieces for the additional denomination are stored in a discrimination criterion information storing device of the coin discrimination apparatus in which the discrimination criterion information pieces for each of the current denominations are stored;

designating a target denomination from the current denominations when it is judged that the discrimination criterion information pieces for the additional denomination are not stored;

calculating the discrimination criterion information pieces for the additional denomination based on discrimination criterion information pieces for the target denomination, target denomination standard information pieces corresponding to the discrimination criterion information pieces for the target denomination, and additional denomination standard information pieces corresponding to the discrimination criterion information pieces for the additional denomination;

storing the calculated discrimination criterion information pieces for the additional denomination in the discrimination criterion information storing device; and setting the coin discrimination apparatus to conduct authentication discrimination and denomination discrimination using the calculated discrimination criterion information pieces for the additional denomination.

With the medium according to the third aspect of the present invention, because of the same reason as described above about the method according to the first aspect of the present invention, the task of visiting the installation location of an existing coin discrimination apparatus to exchange the said apparatus for a new one that includes discrimination criterion information pieces for one or more additional denominations and the task of setting discrimination criterion information pieces for one or more additional denominations manually in an existing coin discrimination apparatus can be eliminated. This means that the discrimination criterion information pieces for one or more additional denominations can be set by simply conducting an updating operation of a control program or firmware that is incorporated in an existing coin discrimination apparatus.

Furthermore, the discrimination error caused by an individual difference in coin discrimination performance of an existing coin discrimination apparatus can be reduced by appropriately designating the target denomination from the current denominations.

In a preferred embodiment of the medium according to the third aspect of the present invention, it is judged whether or not two or more of the target denominations can be designated from the current denominations, and when two or more of the target denominations can be designated from the current denominations, the two or more of the target denominations are selectively used in such a way that differences in value between the target denomination standard information pieces for each of the two or more of the target denominations and the corresponding additional denomination standard information pieces are as small as possible.

In this embodiment, the deviations or errors of the discrimination criterion information pieces for the additional denomination from the corresponding discrimination criterion information pieces for the two or more of the target denominations, which are caused by the fact that the differences in value between the target denomination standard information pieces and the corresponding additional denomination standard information pieces are large, can be reduced. Accordingly, there is an additional advantage that the discrimination error with respect to the additional denomination caused by an individual difference in coin discrimination performance of the coin discrimination apparatus can be reduced.

In another preferred embodiment of the medium according to the third aspect of the present invention, two or more of the target denominations are designated from the current denominations; and the target denomination standard information pieces for each of the two or more of the target denominations are used for calculating the discrimination criterion information pieces for the additional denomination.

In this embodiment, since the discrimination criterion information pieces for the two or more of the target denominations are included in the discrimination criterion information pieces for the additional denomination during the calculation operation of the discrimination criterion information pieces for the additional denomination, there is an additional advantage that the discrimination error with respect to the additional denomination caused by an individual difference in coin discrimination performance of the coin discrimination apparatus can be reduced compared with the case where the discrimination criterion information pieces for f the single target denomination are included, by selectively using the two or more of the target denominations in such a way that differences in value between the target denomination standard information pieces and the corresponding additional denomination standard information pieces are as small as possible, for example.

In still another preferred embodiment of the medium according to the third aspect of the present invention, in a case where it is required to set the discrimination criterion information pieces for two or more of the additional denominations at one time, two or more of the target denominations are switchably designated when calculating the discrimination criterion information pieces for each of the two or more of the additional denominations.

In this embodiment, there is an additional advantage that this medium can cope with a request for setting the discrimination criterion information pieces for two or more of the additional denominations at one time.

In a further preferred embodiment of the medium according to the third aspect of the present invention, ratios between the target denomination standard information pieces corresponding to the discrimination criterion information pieces for the target denomination and the additional denomination standard information pieces corresponding to the discrimination criterion information pieces for the additional denomination are calculated and stored in the coin discrimination apparatus in advance; and the discrimination criterion information pieces for the additional denomination are calculated using the ratios.

In this embodiment, there is an additional advantage that the calculation for obtaining the discrimination criterion information pieces for the additional denomination is simplified.

In a further preferred embodiment of the medium according to the third aspect of the present invention, when the discrimination criterion information pieces for the additional denomination are calculated, the target denomination standard information pieces which have been obtained by executing the coin discrimination of the target denomination in a standard apparatus of the coin discrimination apparatus and the additional denomination standard information pieces which have been obtained by executing the coin discrimination of the additional denomination in the standard apparatus are used.

In this embodiment, there is an additional advantage that the target denomination standard information pieces and the additional denomination standard information pieces are credible and easily obtainable.

In a further preferred embodiment of the medium according to the third aspect of the present invention, (a) a function of storing the target denomination standard information pieces and the additional denomination standard information pieces in the coin discrimination apparatus using the target denomination which is designated in advance, (b) a function of calculating the discrimination criterion information pieces for the additional denomination based on the discrimination criterion information pieces for the target denomination, the target denomination standard information pieces, and the additional denomination standard information pieces, (c) a function of storing the calculated discrimination criterion information pieces for the additional denomination in the discrimination criterion information storing device, and (d) a function of setting the coin discrimination apparatus to conduct authentication discrimination and denomination discrimination using the calculated discrimination criterion information pieces for the additional denomination are realized by single software (e.g., a discrimination criterion information setting system 100).

In this embodiment, there is an additional advantage that the updating operation of the control program or firmware can be conducted even if the storage or memory device of the coin discrimination apparatus into which the control program or firmware is incorporated does not have a sufficient storing capacity for conducting the aforementioned updating operation.

In a further preferred embodiment of the medium according to the third aspect of the present invention, the discrimination criterion information pieces for the target denomination are given by amplitudes of a first set of waveforms that vary according to the sensor information pieces;

the discrimination criterion information pieces for the additional denomination are given by amplitudes of a second set of waveforms that vary according to the sensor information pieces;

the target denomination standard information pieces are given by amplitudes of a third set of waveforms that vary according to the sensor information pieces;

the additional denomination standard information pieces are given by amplitudes of a fourth set of waveforms that vary according to the sensor information pieces; and a relationship between the amplitudes that give the discrimination criterion information pieces for the target denomination and the amplitudes that give the discrimination criterion information pieces for the additional denomination is given by a relationship between the target denomination standard information pieces and the additional denomination standard information pieces.

In a further preferred embodiment of the medium according to the third aspect of the present invention, the discrimination criterion information pieces for the additional denomination include an information item relating to a material of the coins, an information item relating to a thickness of the coins, and an information item relating to a diameter of the coins; and when the information item relating to the diameter of the coins is calculated, one of the current denominations that has a nearest diameter to the additional denomination is designated as the target denomination.

In this embodiment, since one of the current denominations that has a nearest diameter to the additional denomination is designated as the target denomination, the errors between the target denomination standard information pieces and the additional denomination standard information pieces can be surely reduced. Accordingly, there is an additional advantage that the discrimination error with respect to the additional denomination which is caused by an individual difference in coin discrimination performance of the coin discrimination apparatus can be surely reduced.

In a further preferred embodiment of the medium according to the third aspect of the present invention, when the discrimination criterion information pieces for the additional denomination are calculated based on the discrimination criterion information pieces for the target denomination, the target denomination standard information pieces corresponding to the discrimination criterion information pieces for the target denomination, and the additional denomination standard information pieces corresponding to the discrimination criterion information pieces for the additional denomination, two or more calculation methods using predetermined parameter information pieces can be selectively used; and one of the two or more calculation methods is selectively used in such a way as to reduce an effect of fluctuation due to an individual difference of the coin discrimination apparatus.

In this embodiment, there is an additional advantage that the effect of fluctuation due to an individual difference of the coin discrimination apparatus can be surely reduced.

BRIEF DESCRIPTION OF THE DRAWINGS

In order that the present invention may be readily carried into effect, it will now be described in detail with reference to the accompanying drawings.

FIG. 14 is an explanatory drawing showing an example of the contents of the discrimination criterion information pieces for the current denominations stored in the discrimination criterion information storing subsection or unit and the layout (layout of memory areas) thereof in the discrimination criterion information setting system according to the first embodiment of the present invention of FIG. 2; wherein the state where none of the discrimination criterion information pieces for the additional denominations are stored or registered is shown.

FIG. 15 is an explanatory drawing showing an example of the layout (layout of memory areas) of the parameter information storing subsection or unit in which a variety of parameter information pieces used for calculating the discrimination criterion information pieces for the additional denominations are stored in the discrimination criterion information setting system according to the first embodiment of the present invention of FIG. 2; wherein part of the contents of the said parameter information pieces are also shown.

DETAILED DESCRIPTION OF THE INVENTION

Figure 1:
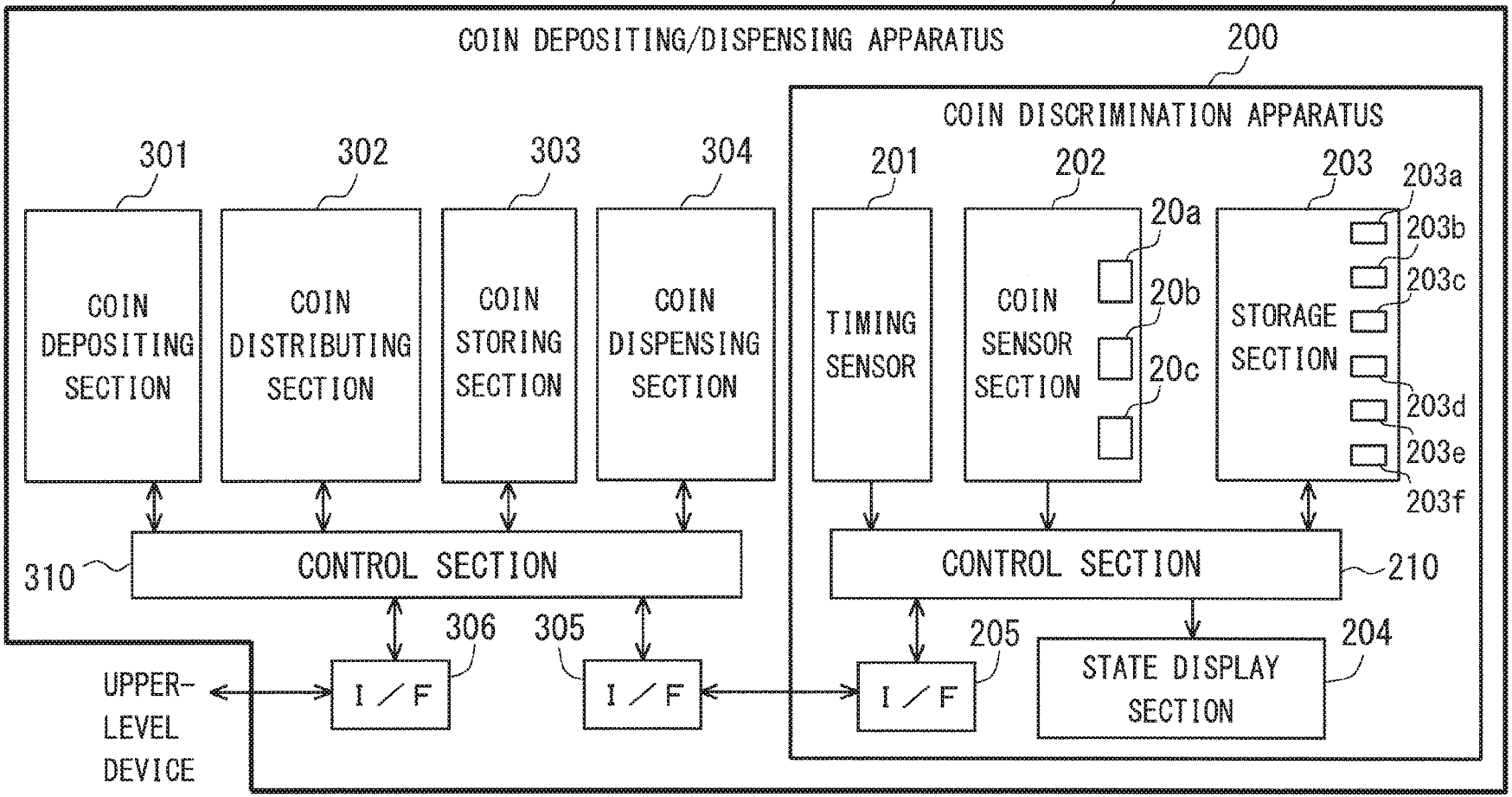
FIG. 1 is a functional block diagram showing the structure of a coin depositing/dispensing apparatus that includes a coin discrimination apparatus, in which a discrimination criterion information setting system according to a first embodiment of the present invention is incorporated into the coin discrimination apparatus.

Preferred embodiments of the present invention will be described in detail below while referring to the drawings attached.

First Embodiment

Figure 2:
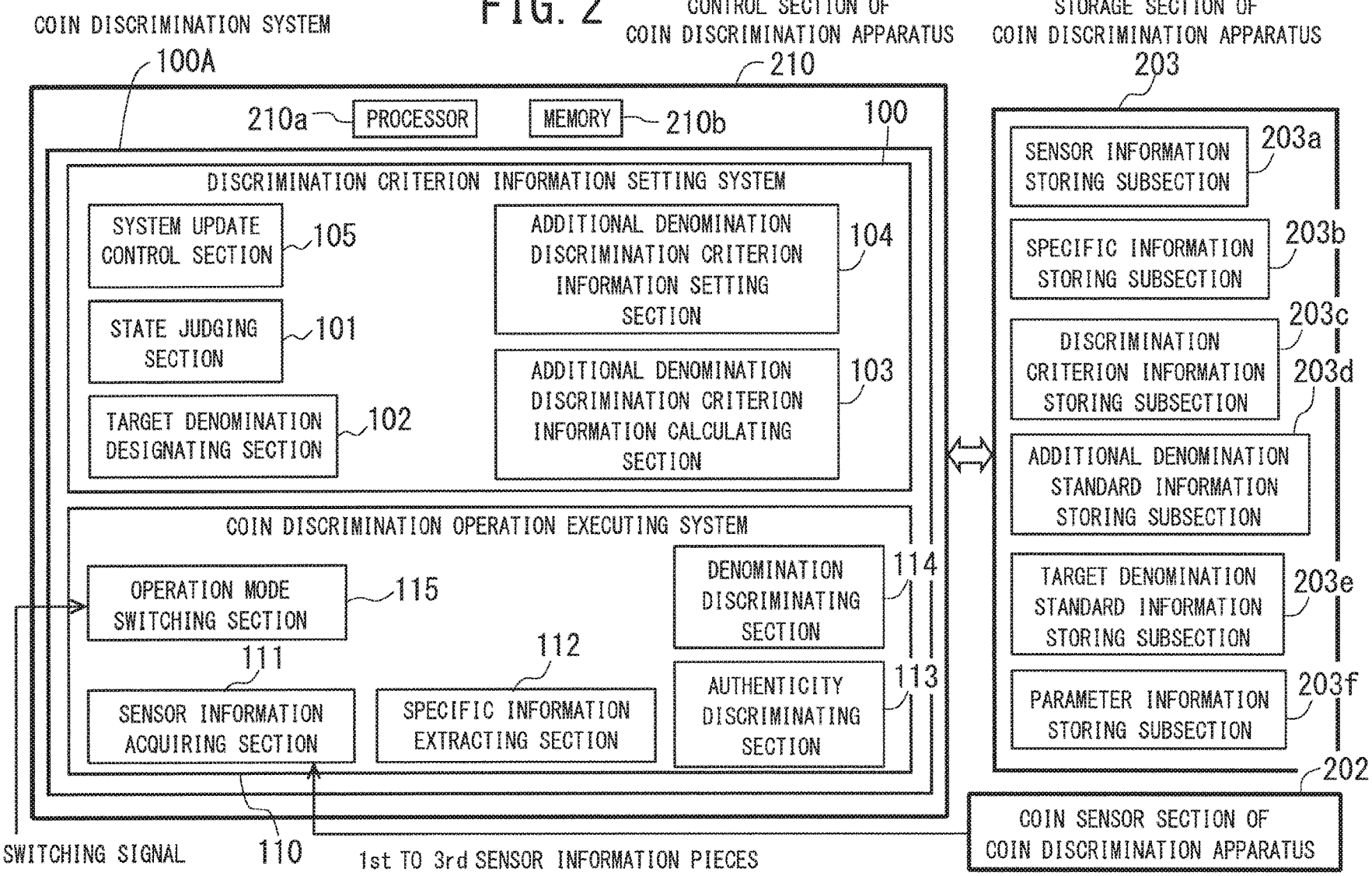
FIG. 2 is a functional block diagram showing the structure of the discrimination criterion information setting system according to the first embodiment of the present invention and that of a coin discrimination operation executing system which works together with this setting system, both of which are incorporated into a control section or unit of the coin discrimination apparatus which is built in the coin depositing/dispensing apparatus of FIG. 1.

The structure of a discrimination criterion information setting system 100 according to a first embodiment of the present invention is shown in FIG. 2, and the structure of a coin depositing/dispensing apparatus 300 into which a coin discrimination apparatus 200 that includes the discrimination criterion information setting system 100 is incorporated is shown in FIG. 1. As shown in FIG. 2, the discrimination criterion information setting system 100 is incorporated into a control section or unit 210 of the coin discrimination apparatus 200 that is provided in the coin depositing/dispensing apparatus 300. The control section or unit 210 is configured as, for example, hardware into which control software or a software controller is incorporated. Concretely speaking, as shown in FIG. 2, a memory 210*b* that stores instructions and a processor 210*a* that executes the instructions stored in the memory 210*b* are provided as the hardware in the control section 210, and the control software including the instructions is stored or installed in the memory 210*b*, thereby realizing the functions of the control section 210 which will be explained later.

In the following explanation, the coin depositing/dispensing apparatus 300 will be described first; then, the coin discrimination apparatus 200 will be described and thereafter, the discrimination criterion information setting system 100 and a coin discrimination operation executing system 110, both of which constitute a coin discrimination system 100A (see FIG. 2), will be explained.

Coin Depositing/Dispensing Apparatus 300

As shown in FIG. 1, the coin depositing/dispensing apparatus 300 comprises the coin discrimination apparatus 200 serving as the coin discriminating section or unit of the apparatus 300, a coin depositing section 301, a coin distributing section 302, a coin storing section 303, a coin dispensing section 304, interfaces (which may be referred to "I/Fs" hereinafter) 305 and 306, and a control section 310.

The control section 310 controls the operations of the coin depositing section 301, the coin distributing section 302, the coin storing section 303, and the coin dispensing section 304. The control section 310 is formed by, for example, hardware in which control software is incorporated. The control section 310 is connected to the coin discrimination apparatus 200 by way of the I/F 305 and signal transmission and reception are possible between the section 310 and the apparatus 200. Thus, the control section 310 can make the operations of the coin depositing section 301, the coin distributing section 302, the coin storing section 303, and the coin dispensing section 304 consistent with the operation of the coin discrimination apparatus 200. Moreover, the control section 310 is connected to an upper-level device (e.g., a cash register, not shown) by way of the I/F 306 and signal transmission and reception are possible between the section 310 and the upper-level device (not shown). Thus, the control section 310 can conduct a variety of operations in response to instructions (e.g., coin dispensing instructions) sent from the upper-level device.

The coin depositing section 301 is a section or unit that separates a lot of coins 30 (see FIG. 3) that are supplied to (i.e., thrown into) the coin depositing/dispensing apparatus 300 through a coin inlet (not shown) from each other to introduce the coins 30 in a desired state or attitude into a coin introducing space (not shown) formed in the apparatus 300, and that sends the coins 30 which are in the desired state or attitude to the coin discrimination apparatus 200 serving as the coin discriminating section or nit of the apparatus 300.

The coin discrimination apparatus 200 serving as the coin discriminating section discriminates the denomination and authenticity of the respective coins 30 that are conveyed from the coin depositing section 301. When the coin 30 is judged counterfeit, the apparatus 200 generates a predetermined authenticity signal and send this signal to the coin distributing section 302. When the coin 30 is judged authentic or true, the apparatus 200 generates a predetermined authenticity signal and a predetermined denomination signal and send these two signals to the coin distributing section 302. The structure and functions of the apparatus 200 will be explained in detail later.

The coin distributing section 302 is a section or unit that distributes the respective coins 30 (which are limited to those judged authentic) sent from the coin discrimination apparatus 200 in response to the authenticity and denomination signals sent from the apparatus 200 into their denominations and that sends the coins 30 thus distributed to the coin storing section 303. Regarding the coins 30 that have been judged counterfeit in the apparatus 200, the section 302 does not send these counterfeit coins 30 to the coin storing section 303 but discharges them to a dispensing tray (not shown) by way of a dedicated path.

The coin storing section 303 is a section or unit that stores the coins 30 (which are limited to those judged authentic) which are distributed into their denominations by the coin distributing section 302 in the storing (receiving) boxes prepared for the respective denominations. For example, the section 303 is configured to include coin storing boxes whose count is equal to the total number of the denominations of the coins 30 to be treated, in which the coins 30 are stored in the coin storing boxes corresponding to their respective denominations by way of corresponding distribution gates (not shown) through different paths.

The coin dispensing section 304 is a section or unit that combines appropriately the coins 30 that have been stored separately in the coin storing section 303 according to their respective denominations in response to dispensing instructions sent from the unillustrated upper-level device (e.g., a cash register) and that takes out the coins 30 thus combined to the outside (concretely, a dispensing tray).

Coin Discrimination Apparatus 200

Next, the coin discrimination apparatus 200 will be explained in detail with reference to FIGS. 1 and 2.

As shown in FIG. 1, the coin discrimination apparatus 200 comprises a timing sensor 201, a coin sensor section 202, a storage section 203, a state display section 204, an I/F 205, and a control section 210.

The timing sensor 201 generates a timing signal (I.e., a clock signal) for sending information (signals) at a predetermined speed at a predetermined time and supplies the timing signal thus generated to the control section 210. The control section 210 operates in synchronization with the timing signal and controls the operations of the coin sensor section 202, the storage section 203, the state display section 204, and the I/F 205 in such a way as to be synchronized with the timing signal. Accordingly, the overall apparatus 200 operates in synchronization with the timing signal (i.e., the clock signal) generated by the timing sensor 201.

Figure 3:
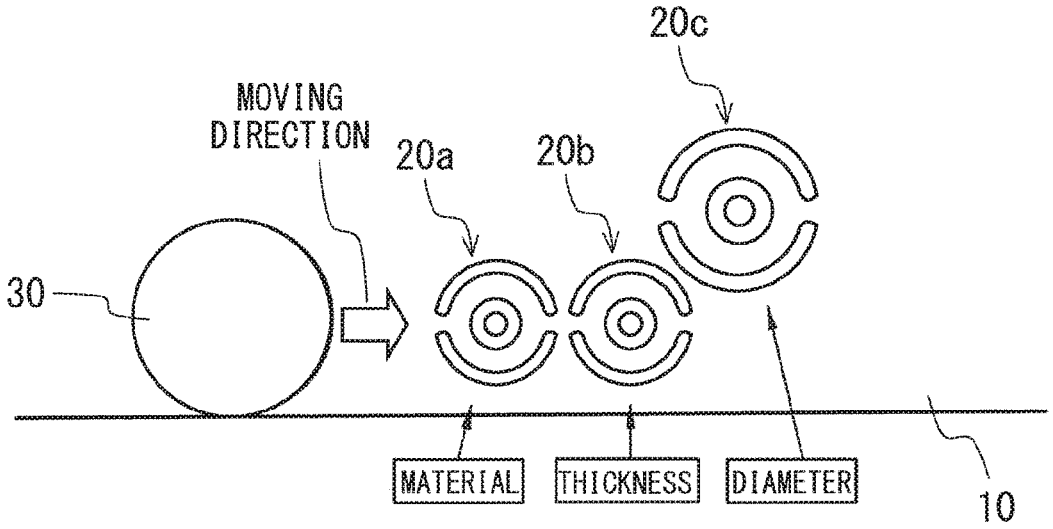
FIG. 3 is a schematic side view showing first to third coin sensors disposed at each side of a coin conveying path and a coin passing through the path in the coin discrimination apparatus of FIG. 1.

The coin sensor section 202 is a section or unit, which includes a plurality of coin sensors, that detects the passage of each coin 30 to output sensor information pieces. Here, as shown in FIG. 3, the section 202 comprises a linear coin conveying path 10, a pair of opposing first coin sensors 20*a*, a pair of opposing second coin sensors 20*b*, and a pair of opposing third coin sensors 20*c*. The pairs of the first, second, and third coin sensors 20*a*, 20*b*, and 20*c* are arranged along the coin conveying path 10 in this order. One end of the path 10 (the left end in FIG. 3) is connected to a coin conveying path (not shown) formed in the coin depositing section 301. The coins 30 thrown from the coin inlet (not shown) into the coin depositing section 301 are separated from each other and sent to the coin conveying path 10 one by one at intervals. The other end of the path 10 (the right end in FIG. 3) is connected to a coin conveying path (not shown) formed in the coin distributing section 302. After the discrimination of the authenticity and denomination of the coins 30 in the coin discrimination apparatus 200 is completed, these coins 30 are sent to the coin distributing section 302 by way of the coin conveying path 10.

Figure 4:
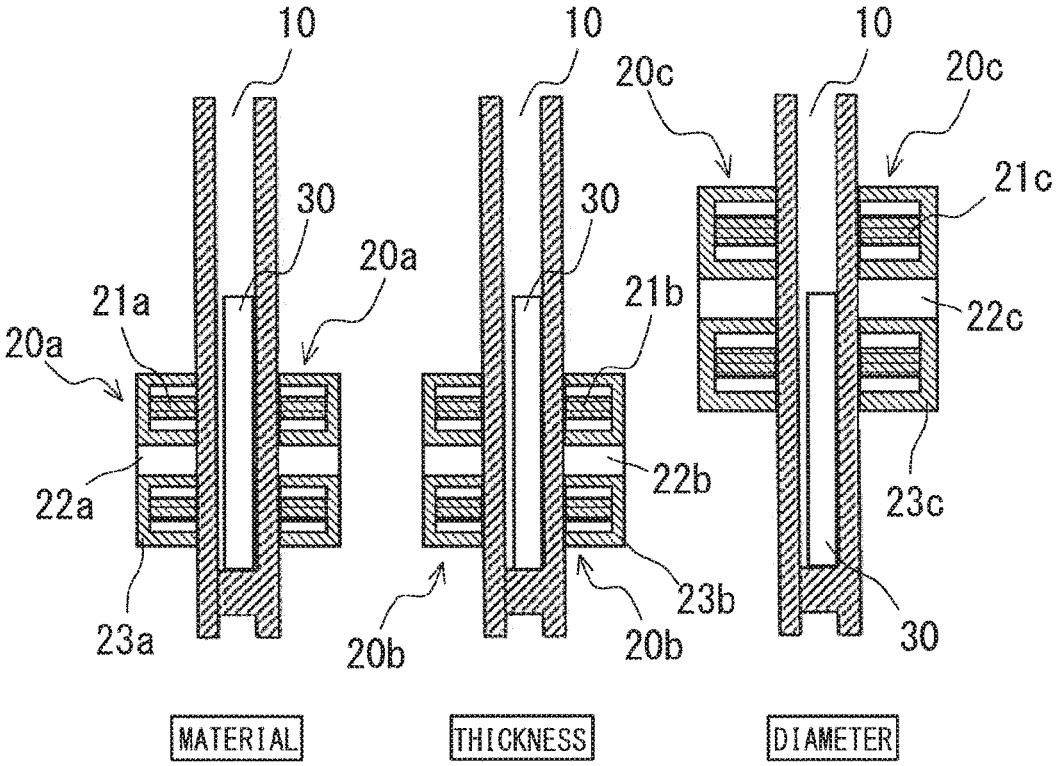
FIG. 4 is a schematic plan view showing the layout of the first to third coin sensors disposed in a coin sensor section or unit of the coin discrimination apparatus of FIG. 1.

The pair of first coin sensors 20*a* and the pair of second coins sensors 20*b* are apart from each other at a predetermined distance along the coin conveying path 10. Similarly, the pair of second coin sensors 20*b* and the pair of third coins sensors 20*c* are apart from each other at a predetermined distance along the path 10. One of the pair of first coin sensors 20*a*, one of the pair of second coins sensors 20*b*, and one of the pair of third coins sensors 20*c* are disposed on one side of the path 10 (e.g., on the far or back side of the path 10 in FIG. 3), and the other of the pair of first coin sensors 20*a*, the other of the pair of second coins sensors 20*b*, and the other of the pair of third coins sensors 20*c* are disposed on the other side of the path 10 (e.g., on the near or front side of the path 10 in FIG. 3). Each coin 30 supplied to the path 10 through the coin depositing section 301 is moved in the direction indicated by the arrow in FIG. 3 through the spaces between the respective pairs of first, second, and third sensors 20*a*, 20*b*, and 20*c*, in which each coin 30 is kept in the standing state shown in FIG. 4 during movement. The pairs of first, second, and third sensors 20*a*, 20*b*, and 20*c* detect the respective moving coins 30 and output respectively first, second, and third sensor information pieces (i.e., sensor signals).

The pair of first coin sensors 20*a* has the same structure and each of the sensors 20*a* comprises a core 22*a*, a coil 21*a* wounded around the core 22*a*, and a cover 23*a*. Each of the sensors 20*a* has an approximately cylindrical shape as a whole and is fixed in such a way that the center of this sensor 20*a* approximately coincides with the trajectories of the centers of the respective coins 30 that are conveyed on the coin conveying path 10 (see FIGS. 3 and 4). The first coin sensors 20*a* are respectively located at the two sides of the path 10 and detect the "material" of each coin 30 conveyed on the path 10 in such a state as to be sandwiched between these two sensors 20*a* by detecting magnetically the physical properties of this coin 30. This means that the first coin sensors 20*a* are "magnetic sensors" that detect magnetically the "material" of each coin 30. In addition, since the diameter of a coin 30 changes according to s denomination, the centers of the first coin sensors 20*a* may be displaced from the trajectories of the centers of the coins 30. For this reason, the diameters of the first coin sensors 20*a* are determined in such a way that no hindrance arises in the detection operation of the "material" of each coin 30, even if the aforementioned displacement occur.

The pair of second coin sensors 20*b* has the same structure and each of the sensors 20*b* comprises a core 22*b*, a coil 21*b* wounded around the core 22*b*, and a cover 23*b*. Similar to the first coin sensors 20*a*, each of the sensors 20*b* has an approximately cylindrical shape as a whole and is fixed in such a way that the center of this sensor 20*b* approximately coincides with the trajectories of the centers of the respective coins 30 that are conveyed on the coin conveying path 10. The second coin sensors 20*b* are respectively located at the two sides of the path 10 and detect the "thickness" of each coin 30 conveyed on the path 10 in such a state as to be sandwiched between these two sensors 20*b* by detecting magnetically the physical properties of this coin 30. This means that the second coin sensors 20*b* are "magnetic sensors" that detect magnetically the "thickness" of each coin 30. In addition, since the diameter of a coin 30 changes according to its denomination, the centers of the second coin sensors 20*b* may be displaced from the trajectories of the centers the coins 30. For this reason, the diameters of the second coin sensors 20*b* are determined in such a way that no hindrance arises in the detection operation of the "thickness" of each coin 30, even if the aforementioned displacement occurs.

The pair of third coin sensors 20*c* has the same structure and each of the sensors 20*c* comprises a core 22*c*, a coil 21*c* wounded around the core 22*c*, and a cover 23*c*. Similar to the first and second coin sensors 20*a* and 20*b*, each of the third coin sensors 20*c* has an approximately cylindrical shape as a whole. However, unlike the first and second coin sensors 20*a* and 20*b*, the third coin sensors 20*c* are fixed in such a way as to be partially overlapped with the respective coins 30 that are conveyed on the coin conveying path 10. The third coin sensors 20*c* are respectively disposed at positions which are apart upward from the bottom of the conveying path 10, which is different from the first and second coin sensors 20*a* and 20*b*, because the first and second coin sensors 20*a* and 20*b* are disposed near the bottom of the path 10. The third coin sensors 20*c* are respectively located at the two sides of the path 10 and detect the "diameter" of each coin 30 conveyed on the path 10 in such a state as to be sandwiched between these two sensors 20*c* by detecting magnetically the physical properties of this coin 30. This means that the third coin sensors 20*c* are "diameter sensors" that detect magnetically the "diameter" of each coin 30. In addition, since the diameter of a coin 30 changes according to its denomination, the overlapping degree (i.e., the overlapping state) of the third coin sensors 20*c* with each coin 30 varies. For this reason, the relative positions of the third coin sensors 20*c* to each coin 30 are determined in such a way that no hindrance arises in the detection operation of the "diameter" of each coin 30, even if the aforementioned overlapping degree or state decreases.

The storage section 203 is a section or unit that stores a plurality of predetermined information pieces and formed by any known storage or memory device or devices. As shown in FIG. 2, the storage section 203 comprises six subsections, i.e., a sensor information storing subsection 203*a*, a specific information storing subsection 203*b*, a discrimination criterion information storing subsection 203*c*, an additional denomination standard information storing subsection 203*d*, a target denomination standard information storing subsection 203*e*, and a parameter information storing subsection 203*f*.

Figure 5:
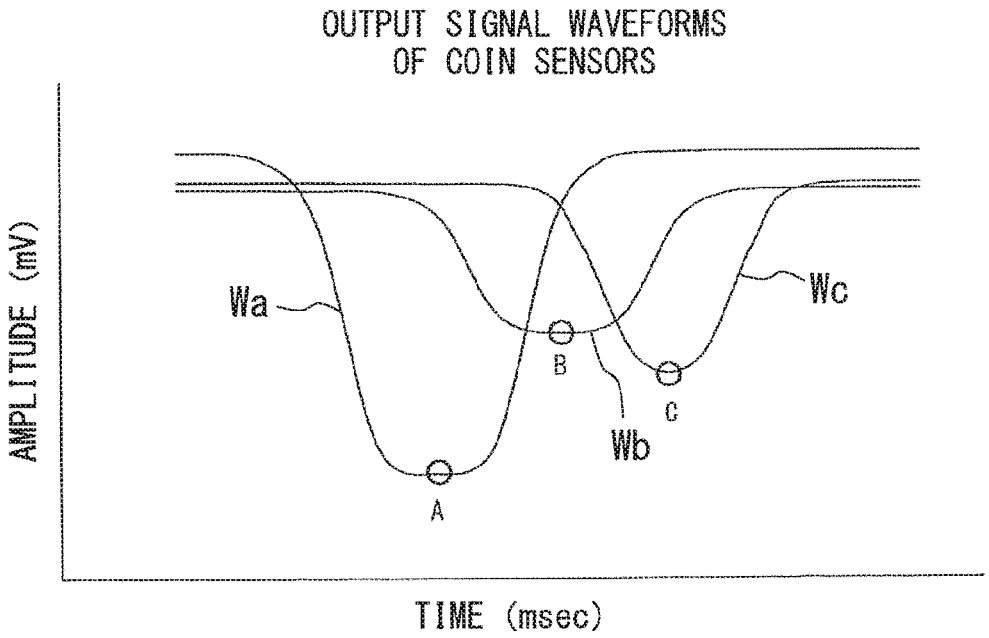
FIG. 5 is an explanatory drawing showing the relationship among the three output signal waveforms obtained from the first to third coin sensors in the coin sensor section or unit of the coin discrimination apparatus of FIG. 1.

The sensor information storing subsection 203*a* is a subsection or unit that stores the first, second, and third sensor information pieces (output signals) outputted respectively from the first, second, and third coin sensors 20*a*, 20*b*, and 20*c*. Each of the first, second, and third sensor information pieces is an analog information piece and their values vary according to the detection of every coin 30. Concretely speaking, for example, each of the first, second, and third sensor information pieces is a waveform signal as shown in FIG. 5 and thus, fluctuation parts (valley parts) are generated at different timings due to the passage of each coin 30. This is because the pairs of first, second, and third coin sensors 20*a*, 20*b*, and 20*c* are arranged at predetermined intervals along the linear coin conveying path 10.

As the sensor information storing subsection 203*a*, any type of a rewritable storage or memory device or devices may be used, however, it is preferred that any type of a volatile memory device or devices, e.g., a Random Access Memory (RAM) or RAMs, is/are used. Since the first to third sensor information pieces are utilized to extract first to third specific information pieces for every coin 30 which will be explained later, these information pieces need to be stored temporarily; however, after extraction of the first to third specific information pieces is completed, they are not necessary. When a RAM or RAMs is/are used as the sensor information storing subsection 203*a*, the first to third sensor information pieces, which are outputted respectively from the first, second, and third coin sensors 20*a*, 20*b*, and 20*c* whenever a plurality of coins 30 are successively conveyed on the coin conveyance path 10, can be overwritten, which results in convenience.

The specific information storing subsection 203*b* is a subsection or unit that stores the specific information pieces extracted from the first, second, and third sensor information pieces. Dedicated memory areas (memory addresses) in this subsection 203*b* are respectively assigned to the specific information pieces and therefore, the subsection 203*b* is configured to store respectively the specific information pieces in the corresponding memory areas. Concretely speaking, for example, when the first, second, and third sensor information pieces are respectively expressed in the form of waveform as shown by the waveforms Wa, Wb, and Wc in FIG. 5 (i.e., waveform information pieces), the specific information pieces are respectively given by, for example, the minimum values of the amplitude (voltage) of these waveforms Wa, Wb, and Wc serving as the first, second, and third sensor information pieces, i.e., the minimum voltage values at the points A, B, and C in FIG. 5. Thus, these minimum voltage values at the points A, B, and C are stored in the corresponding dedicated memory areas of the subsection 203*b*, respectively. In addition, it is needless to say that any other value than the minimum value may be used as each of the specific information pieces and that the total number of the specific information pieces may be set as 4 or more.

As the specific information storing subsection 203*b*, any type of a rewritable storage or memory device or devices may be used, however, it is preferred that an electrically erasable programmable non-volatile memory device or devices, e.g., an EEPROM (Electrically Erasable Programmable Read-Only Memory) or EEPROMs, is/are used. This is because the extracted specific information pieces need to be stored in order to compare the specific information pieces that are successively extracted in response to the conveyance of the coins 30 with corresponding discrimination criterion information pieces for authenticity discrimination and denomination discrimination of every coin 30.

The discrimination criterion information storing subsection 203*c* is a subsection or unit that stores the discrimination criterion information pieces that are set for each of the current denominations (for example, in the case of Japanese Yen, 6 denominations of 1 Yen, 5 Yen, 10 Yen, 50 Yen, 100 Yen, and 500 Yen). Here, the subsection 203*c* is configured to store the discrimination criterion information pieces for each denomination (which relate to the material, thickness, and diameter) corresponding to the aforementioned first, second, and third coin sensors 20*a*, 20*b*, and 20*c*. At the time of factory shipment of the coin discrimination apparatus 200, the discrimination criterion information pieces are stored in the subsection 203*c* for each of the denominations; however, taking the necessity of newly setting discrimination criterion information pieces for one or more additional denominations into consideration after the time of factory shipment, dedicated memory areas (memory addresses) for the new discrimination criterion information pieces to be used for one or more additional denominations are prepared in the subsection 203*c* in advance.

As the discrimination criterion information storing subsection 203*c*, any type of a storage or memory device or devices may be used; however, it is preferred that an electrically erasable programmable non-volatile memory device or devices, e.g., an EEPROM or EEPROMs, is/are used. This is because (i) the discrimination criterion information pieces presuppose long-term use and (ii) there is a possibility that the initial discrimination criterion information pieces, which are set and stored initially at the time of factory shipment, may be changed after the beginning of use of the coin discrimination apparatus 200, and that new discrimination criterion information pieces need to be additionally stored after the beginning of use of the apparatus 200. Since an EEPROM or EEPROMs can easily cope with these situations, the current or existing discrimination criterion information pieces can be easily changed and new discrimination criterion information pieces can be easily added.

The additional denomination standard information storing subsection 203*d* is a subsection or unit that stores additional denomination standard information pieces. The additional denomination standard information pieces are standard information pieces that are set for one or more additional denominations to be newly added to the current denominations i.e., the denominations to be discriminated currently. Here, the meaning of standard information pieces is information pieces used as a "standard to comply with" for discrimination criterion information pieces to be newly set for an additional denomination. Since all enterprises that manufacture the coin discrimination apparatus 200 undoubtedly have a standard apparatus of this apparatus 200, the "additional denomination standard information pieces" for the apparatus 200 can be easily obtained by conducting the authenticity discrimination and denomination discrimination of coins for an additional denomination using the standard apparatus.

As the additional denomination standard information storing subsection 203*d*, any type of a storage or memory device or devices may be used; however, it is preferred that an electrically erasable programmable non-volatile memory device or devices, e.g., an EEPROM or EEPROMs, is/are used. This is because there is a possibility that the initial standard information pieces may be changed or deleted in accordance with the change of circumstances or new standard information pieces need to be added after the beginning of use. Moreover, this is because the additional denomination standard information pieces presuppose long-term use also. An EEPROM or EEPROMs can easily cope with these situations.

The target denomination standard information storing subsection 203*e* is a subsection or unit that stores the target denomination standard information pieces. The target denomination standard information pieces are standard information pieces that are set for a target denomination or denominations. The "target denomination(s)" is/are one or more denominations that is/are designated from the current denominations to be currently discriminated for the purpose of identifying standard information pieces (i.e., the target denomination standard information pieces) that will be used in combination with the additional denomination standard information pieces at the time of setting discrimination criterion information pieces for the additional denomination. The "target denomination standard information pieces" for the coin discrimination apparatus 200 can be easily obtained by conducting the authenticity discrimination and denomination discrimination of coins having each target denomination using the aforementioned standard apparatus.

As the target denomination standard information storing subsection 203*e*, any type of a storage or memory device or devices may be used; however, it is preferred that an electrically erasable programmable non-volatile memory device or devices, e.g., an EEPROM or EEPROMs, is/are used. This is because the target denomination(s) is/are designated whenever the discrimination criterion information pieces for the additional denomination are set and because the target denomination standard information pieces need to be stored for a long time. An EEPROM or EEPROMs can easily cope with these situations.

The parameter information storing subsection 203*f* is a subsection or unit that stores the parameter information pieces to be used at the time of calculating the discrimination criterion information pieces for the additional denomination. Here, the "parameter information pieces" are information pieces used as a parameter or parameters at the time of calculating the discrimination criterion information pieces for the additional denomination based on the discrimination criterion information pieces for the target denomination, the target denomination standard information pieces corresponding to the discrimination criterion information pieces for the target denomination, and the additional denomination standard information pieces corresponding to the discrimination criterion information pieces for the additional denomination. Since there are two or more calculation methods which are used for calculation of the discrimination criterion information pieces for the additional denomination here, a plurality sets of parameter information pieces for different parameters are set and stored in the subsection 203*f* in advance for these calculation methods. For example, as shown in FIG. 15, the parameter information pieces are Ak1, Ak2, (Ax_0/Ak1_0), V1/V2, and V3/V4.

As the parameter information storing subsection 203*f*, any type of a storage or memory device or devices may be used; however, it is preferred that an electrically erasable programmable non-volatile memory device or devices, e.g., an EEPROM or EEPROMs, is/are used. This is because there is a possibility that the parameter information pieces may be changed whenever the target denomination is changed for calculating the discrimination criterion information pieces for the additional denomination and that the parameter information pieces need to be stored for a long time. An EEPROM or EEPROMs can easily cope with these situations.

The state display section 204 is a section or unit that displays the operation state of the coin discrimination apparatus 200 on the predetermined display area (not shown), thereby notifying the user, administrator, and/or service engineer in charge about the current operation state, the occurrence of errors and so on of the apparatus 200 (the coin depositing/dispensing apparatus 300). The state display section 204 can be realized using any type of display device, for example, a set of LEDs (Light Emitting Diodes) each emitting different color light or a small-sized LCD (Liquid Crystal Display) panel. Because the state display section 204 is provided, when a counterfeit coin is discovered by the operation of the coin discrimination apparatus 200 or some abnormality occurs in the coin discrimination operation, such the state can be immediately notified the user, administrator, and/or service engineer.

The I/F 205 connects the control section 210 of the coin discrimination apparatus 200 to the control section 310 that controls the coin depositing section 301, the coin distributing section 302, the coin storing section 303, and the coin dispensing section 304 by way of the I/F 305 provided outside the apparatus 200. For this reason, the operation of the apparatus 200 can be controlled so as to be matched with the operations of the coin depositing section 301, the coin distributing section 302, the coin storing section 303, and the coin dispensing section 304.

The control section 210 comprises the discrimination criterion information setting system 100 according to the first embodiment of the present invention and the coin discrimination operation executing system 110, as shown in FIG. 2. In other words, the discrimination criterion information setting system 100 and the coin discrimination operation executing system 110 are incorporated into the control section 210. The combination of these two systems 100 and 110 constitutes a coin discrimination system 100A, which is configured to realize the predetermined coin discrimination operation of the coin discrimination apparatus 200.

Coin Discrimination System 100A

As explained above, the coin discrimination system 100A is formed by the discrimination criterion information setting system 100 and the coin discrimination operation executing system 110. Thus, in the following explanation, first, the discrimination criterion information setting system 100 will be explained in detail, and thereafter, the coin discrimination operation executing system 110 will be explained in brief.

Discrimination Criterion Information Setting System 100

The discrimination criterion information setting system 100 according to the first embodiment of the present invention is activated in the case where one or more additional denominations need to be added to the current denominations which are to be discriminated currently. This system 100 has the functions of (i) calculating the discrimination criterion information pieces for the one or more desired additional denominations, (ii) storing the discrimination criterion information pieces for the additional denomination(s) thus calculated in the discrimination criterion information storing subsection 203*c* of the storage section 203 of the coin discrimination apparatus 200, and (iii) changing the setting of the control section 210 of the apparatus 200 in such a way as to discriminate the coins having the one or more additional denominations in addition to the coins having the current denominations.

Figure 16A:
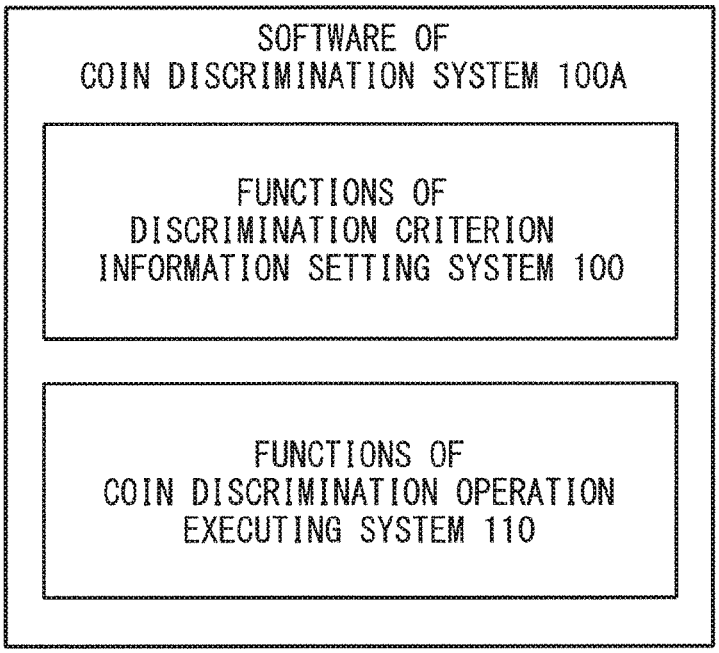
FIG. 16A is a conceptual diagram showing the configuration of the coin discrimination system in the case where the functions of the discrimination criterion information setting system according to the first embodiment of the present invention shown in FIG. 2 and those of the coin discrimination operation executing system are combined together to thereby form single software of the coin discrimination system.

Here, the coin discrimination system 100A that includes the discrimination criterion information setting system 100 and the coin discrimination operation executing system 110 is configured as single software or firmware, as shown in FIG. 16A. For this reason, if a new version of the current coin discrimination system 100A which is currently installed and executed in the control section 210 is formed so as to include appropriate modifications and then, the new version thus formed is installed to overwrite the current system 100A, the current system 100A can be updated for modification and/or improvement of the functions thereof.

The overall structure of the discrimination criterion information setting system 100 is shown in FIG. 2. This system 100 comprises a state judging section 101, a target denomination designating section 102, an additional denomination discrimination criterion information calculating section 103, an additional denomination discrimination criterion information setting section 104, and a system update control section 105.

The state judging section 101 is a unit or controller that judges whether or not the discrimination criterion information pieces for a desired additional denomination or denominations is stored in the discrimination criterion information storing subsection 203*c* of the storage section 203 and that sends a signal responsive to a judgment result (i.e., a judgment result signal) to the target denomination designation section 102.

As described above, the discrimination criterion information pieces which are set or assigned to each of the current denominations are stored in the discrimination criterion information storing subsection 203*c* in advance. Concretely speaking, for example, 10 discrimination criterion information pieces are currently set and stored for each of the 6 denominations of 1 Yen, 5 Yen, 10 Yen, 50 Yen, 100 Yen, and 500 Yen. This means that the 60 discrimination criterion information pieces in total are currently stored in the storing subsection 203*c*. The storing subsection 203*c* is configured in such a way that the discrimination criterion information pieces to be added for each of the one or more additional denominations are stored in their dedicated memory areas (memory addresses), which are different from the dedicated memory areas (memory addresses) in which the 60 discrimination criterion information pieces for the current denominations are stored. Thus, whether or not the discrimination criterion information pieces for each of the one or more additional denominations are stored in the storing subsection 203*c* can be easily judged by sequentially searching the dedicated memory areas (memory addresses) prepared for the discrimination criterion information pieces for the additional denominations using the state judging section 101. Accordingly, in response to the judgment result generated by the state judging section 101, the section 101 sends the judgment result signal indicating the "non-existence of unregistered denominations" (which means that the discrimination criterion information pieces are stored for all the additional denominations) or the "existence of unregistered denominations" (which means that the discrimination criterion information pieces are not stored for at least part of the additional denominations) to the target denomination designating section 102.

The target denomination designating section 102 is a unit or controller that designates one or more of the target denominations from the current denominations in the case where it is judged by the state judging section 101 that the discrimination criterion information pieces for the desired additional denomination(s) are not stored in the discrimination criterion information storing subsection 203*c*. When the content of the judgment result signal sent from the state judging section 101 is the "non-existence of unregistered denominations", the target denomination designating section 102 sends a predetermined activation signal to the coin discrimination operation executing system 110, thereby activating the same. Due to this action, the system 110 starts to execute the predetermined coin discrimination operations thereof. In this way, the coin discrimination apparatus 200 is shifted to its ordinary working state.

On the other hand, when the content of the judgement result signal is the "existence of unregistered denominations", the target denomination designating section 102 designates one or more target denominations from the current denominations, generates a target denomination designation signal notifying the one or more target denominations thus designated, and sends this signal to the additional denomination discrimination criterion information calculating section 103. The target denomination designating section 102 designates automatically one or more target denominations in accordance with a predetermined rule, for example, "a rule for designating one denomination of the minimum or maximum amount out of the current denominations". Alternately, two or more of the target denominations may be designated as a predetermined rule to be selectively used in such a way that differences in value between the target denomination standard information pieces of each of the two or more of the target denominations and the corresponding additional denomination standard information pieces are as small as possible. It is needless to say that this rule may be set or changed according to the necessity.

The additional denomination discrimination criterion information calculating section 103 is a unit or controller that calculates the discrimination criterion information pieces for one or more additional denominations based on the discrimination criterion information pieces for the designated target denomination(s), the target denomination standard information pieces corresponding to the discrimination criterion information pieces for the designated target denomination(s), and the additional denomination standard information pieces corresponding to the discrimination criterion information pieces for the one or additional denominations. Typically, the section 103 (i) calculates the discrimination criterion information pieces for the additional denomination using a predetermined calculation method while handling the current denomination which is designated as the target denomination by the target denomination designation signal sent from the target denomination designating section 102, (ii) stores the calculated discrimination criterion information pieces for the additional denomination in the discrimination criterion information storing subsection 203*c*, and (iii) sends the calculated discrimination criterion information pieces for the additional denomination thus stored to the additional denomination discrimination criterion information setting section 104. The concrete calculation method will be explained later.

The additional denomination discrimination criterion information setting section 104 is a unit or controller that sets coin discrimination apparatus 200 to conduct its authentication discrimination and denomination discrimination using the discrimination criterion information pieces for the one or more additional denominations in addition to those for the current denominations. Specifically, the section 104 receives the calculated discrimination criterion information pieces for the additional denomination sent from the calculating section 103 and then, sets up the configuration of the coin discrimination operation executing system 110 in such a way that the calculated discrimination criterion information pieces thus received will be used in an authenticity discrimination section 113 and a denomination discrimination section 114 (both of which will be explained later) of the coin discrimination operation executing system 110, thereby making it possible to conduct the authenticity discrimination and the denomination discrimination of coins with respect to not only the current denominations but also the additional denomination.

The system update control section 105 is a unit or controller that controls the update operation of the coin discrimination system 100A including the discrimination criterion information setting system 100 and the coin discrimination operation executing system 110. When receiving a predetermined signal by way of a communication network such as the Internet, the section 105 automatically updates the coin discrimination system 100A (in other words, overwrite install a new version that includes the one or more additional denominations and the discrimination criterion information pieces used therefor) and then, automatically execute the operation of the coin discrimination system 100A.

Coin Discrimination Operation Executing System 110

Next, the coin discrimination operation executing system 110 will be explained below.

The coin discrimination operation executing system 110 is a system or controller that conducts the ordinary or usual (known) coin discrimination operation of the coin discrimination apparatus 200. Concretely speaking, the system 110 conducts a series of operations for discriminating the authenticity and denomination of individual coins 30 which are successively conveyed through the coin conveying path 10 based on the first to third sensor information pieces sent from the coin sensor section 202.

The coin discrimination operation executing system 110 has the structure as shown in FIG. 2. The system 110 comprises a sensor information acquiring section 111, a specific information extracting section 112, an authenticity discriminating section 113, a denomination discriminating section 114, and an operation mode switching section 115.

The sensor information acquiring section 111 is a unit or controller that acquires the first, second, and third sensor information pieces (all of which are analog information pieces) outputted respectively from the first, second, and third coin sensors 20*a*, 20*b*, and 20*c* provided in the coin sensor section 202, and stores these sensor information pieces in the sensor information storing subsection 203*a* of the storage section 203.

The specific information extracting section 112 is a unit or controller that (i) reads the first, second, and third sensor information pieces, which have been acquired and stored in the sensor information storing subsection 203*a* by the sensor information acquiring section 111, (ii) extracts the specific information pieces to be used for authenticity and denomination discriminations of each coin 30 from the first to third sensor information pieces, and (iii) stores the specific information pieces thus extracted in the specific information storing subsection 203*b*.

The authenticity discriminating section 113 is a unit or controller that discriminates the authenticity of each coin 30 by (i) reading the specific information pieces that have been stored in the specific information storing subsection 203*b* and the discrimination criterion information pieces for each of the current denominations that have been stored in the discrimination criterion information storing subsection 203*c* and (ii) comparing the specific information pieces with the discrimination criterion information pieces for each current denomination. The section 113 generates an authenticity signal indicating that a coin 30 which is currently discriminated is "an authentic one" or "a counterfeit one" according to the result of authenticity discrimination of the coin 30 and then, sends the authenticity signal thus generated to the coin distributing section 302. When the section 302 receives the authenticity signal indicating "authentic", the section 302 sends the coin 30 thus discriminated to the denomination discriminating section 114. When the coin distributing section 302 receives the authenticity signal indicating "counterfeit", the section 302 sends the coin 30 thus discriminated to the coin dispensing section 304, thereby discharging the said coin 30 into a dispensing tray (not shown).

The denomination discriminating section 114 is a unit or controller that discriminates the denomination of each coin 30 by (i) reading the specific information pieces that have been stored in the specific information storing subsection 203*b* and the discrimination criterion information pieces for each of the current denominations that have been stored in the discrimination criterion information storing subsection 203*c* and (ii) comparing the specific information pieces with the discrimination criterion information pieces for each current denomination. The section 114 generates a denomination signal indicating the denomination of a coin 30 which is currently discriminated (which is limited to the coin judged authentic) according to the result of denomination discrimination and then, sends the denomination signal thus generated to the coin distributing section 302. The section 302 distributes coin 30 according to the denomination signal thus received and sends the coin 30 to the coin storing section 303. This section 303 stores the coin 30 thus received into the storing boxes (not shown) which have been prepared for the respective denominations.

Since the operations of the authenticity discriminating section 113 and the denomination discriminating section 114 are common in the part where the specific information pieces are compared with the discrimination criterion information pieces for each of the current denominations, both of the authenticity discrimination and the denomination discrimination may be carried out through this information comparing part or process. In other words, if a coin 30 which is currently discriminated corresponds to any one of the prescribed denominations, it is judged that the said coin 30 is an authentic one having the corresponding denomination; on the other hand, if a coin 30 which is currently discriminated does not correspond to any one of the prescribed denominations, it is judged that the said coin 30 is a counterfeit one. In this case, since the common judgement part conducts both of the operations of the authenticity discriminating section 113 and the denomination discriminating section 114, the said part can be termed the "authentication and denomination discriminating section".

The operation mode switching section 115 is a unit or controller that switches the operation mode of the coin discrimination operation executing system 110 according to the necessity. The system 110, which has the "normal mode" and the "new denomination adding mode", is configured to conduct the following operations: Specifically, the system 110 is kept in the "normal mode" (see FIG. 13) where a series of normal or ordinary coin discrimination operations are carried out except that this system 110 is in the "new denomination adding mode" (see FIG. 12) where discrimination criterion information pieces for one or more additional denominations are set in addition to the discrimination criterion information pieces for the current denominations by the discrimination criterion information setting system 100. The operation mode switching section 115 conducts the switching operation between the "normal mode" and the "new denomination adding mode" in response to a predetermined external switching signal sent from the outside of the control section 210 of the coin discrimination apparatus 200. Here, a "new denomination adding instruction", which is an instruction to register or store the discrimination criterion information pieces for the one or more additional denominations, is used as the predetermined external switching signal. When the operation mode switching section 115 receives the "new denomination adding instruction", this section 115 automatically switches the operation mode of the coin discrimination operation executing system 110 to the "new denomination adding mode" from the "normal mode". In the "new denomination adding mode", the discrimination criterion information setting system 100 conducts the operations of setting the discrimination criterion information pieces for the one or more additional denominations in addition to those for the current denominations. After the series of operations of the "new denomination adding mode" (see FIG. 12) by the system 100 are completed, in other words, registration of the one or more additional denominations and their discrimination criterion information pieces according to the "new denomination adding instruction" are completed, the operation mode switching section 115 automatically switches the operation mode of the system 110 to the "normal mode" from the "new denomination adding mode". In addition, if the switching between the "normal mode" and the "new denomination adding mode" is unnecessary, the operation mode switching section 115 may be cancelled.

Figure 12:
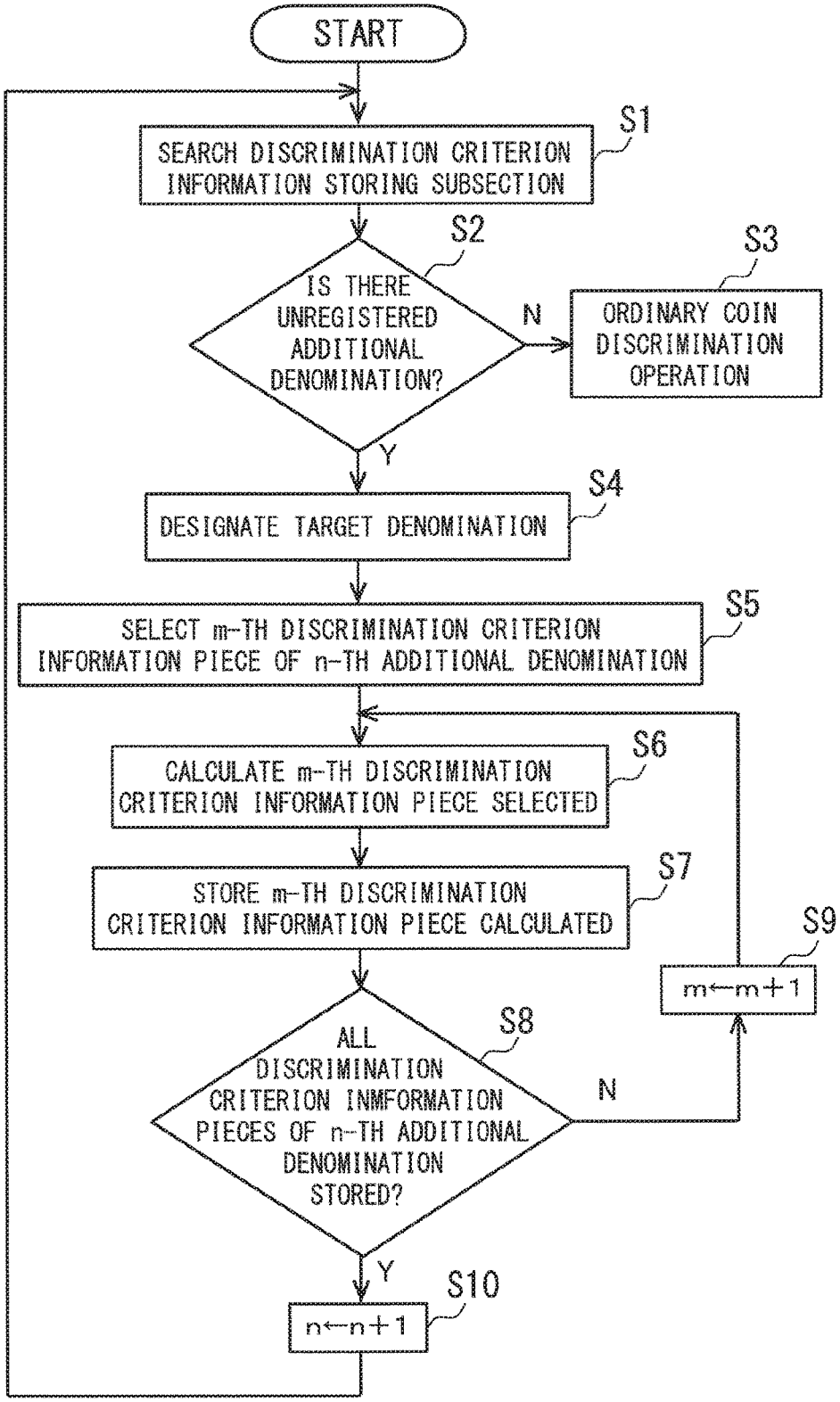
FIG. 12 is a flowchart showing the series of operations of the discrimination criterion information setting system according the first embodiment of the present invention shown in FIG. 2.

As described above, the coin discrimination operation executing system 110 continues to conduct the series of the operations in the normal mode unless receiving the new denomination adding instruction. When the system 110 receives the new denomination adding instruction, the operation mode of the system 110 is temporarily switched to the new denomination adding mode from the normal mode and then, the series of operations of the new denomination adding mode shown in FIG. 12 are conducted by the discrimination criterion information setting system 100. When the series of operations of the new denomination adding mode are completed, in other words, the registration of the additional denomination(s) and its/their discrimination criterion information pieces as instructed is completed, the operation mode of the system 110 is immediately switched back to the normal mode and then, the series of operations of the normal mode shown in FIG. 13 are started again.

Operation of Discrimination Criterion Information Setting System 100

Next, the operation of the discrimination criterion information setting system 100 having the aforementioned structure and functions will be explained below with reference to the flowchart of FIG. 12.

Here, it is supposed that the current denominations Dc of coins 30 to be currently discriminated in the coin discrimination apparatus 200 are five denominations of D1, D2, D3, D4, and D5. Moreover, it is supposed that the additional denominations Da to be added to the current denominations Dc of D1 to D5 are two denominations of D6 and D7.

An example of the state or layout of the discrimination criterion information pieces for the five current denominations D1, D2, D3, D4, and D5 stored in the discrimination criterion information storing subsection 203*c* is shown in FIG. 14. In the example of FIG. 14, each of the current denominations D1, D2, D3, D4, and D5 (the denomination Nos. of which are 1, 2, 3, 4, and 5, respectively) has a predetermined number of discrimination criterion information pieces Pa, Pb, Pc, Pd, Pe, Pf, . . . and Px to which dedicated memory areas (memory addresses) are assigned in one-to-one correspondence. Thus, the values of the discrimination criterion information pieces Pa, Pb, Pc, Pd, Pe, Pf, . . . and Px for each of the current denominations D1 to D5 are stored in their dedicated memory areas (memory addresses) of the discrimination criterion information storing subsection 203*c*. For example, the discrimination criterion information pieces for the current denomination D1 (the denomination No. of which is 1) have values 1Pa, 1Pb, 1Pc, 1Pd, 1Pe, 1Pf, . . . and 1Px. Since the discrimination criterion information pieces for each of the denominations D6, D7, D8, . . . (the denomination Nos. of which are 6, 7, 8, . . . , respectively) do not have values so far in this example, no values are stored in their dedicated memory areas (memory addresses) of the storing subsection 203*c*, all of which are labelled "UNREGISTRED". This means that coin discrimination cannot be performed for the denominations D6, D7, D8, . . . . As explained later, when the discrimination criterion information pieces for the additional denominations D6 and D7 are calculated and stored in their memory areas of the storing subsection 203*c* by the discrimination criterion information setting system 100, coin discrimination will be able to be performed with respect to the additional denominations D6 and D7 also in addition to the current denominations D1 to D5.

FIG. 15 shows an example of the state or layout of the parameter information pieces, which are used for calculating the discrimination criterion information pieces for the additional denominations D6 and D7 (the denomination Nos. of which are 6 and 7, respectively), stored in the parameter information storing subsection 203*f*. At the right-side end of FIG. 15, the parameter information pieces Ak1, Ak2, (Ax_0/Ak1_0), (V1/V2), and (V3/V4) are shown. When the parameter information pieces used for calculating the discrimination criterion information pieces of the additional denominations D6 and D7 are stored in advance in their dedicated memory areas of the storing subsection 203*f* in this way, there is an advantage that desired discrimination criterion information pieces for the additional denominations D6 and D7 can be calculated quickly.

As explained above, all of the first, second, and third coin sensors 20*a*, 20*b*, and 20*c* are magnetic sensors and arranged at predetermined intervals along the linear coin conveying path 10, as shown in FIG. 3. For this reason, when a coin 30 which is conveyed on the path 10 passes in this order through the vicinities of the coin sensors 20*a*, 20*b*, and 20*c*, the first, second, and third sensor information pieces as the output signals that are respectively outputted from the first, second, and third sensors 20*a*, 20*b*, and 20*c* fluctuate temporarily at different times. Accordingly, for example, the first to third sensor information pieces are respectively expressed as the waveform signals Wa, Wb, and Wc shown in FIG. 5. The time at which the fluctuation of the amplitude (voltage value) of the waveform signal Wa as the first sensor information piece is the earliest, which relates to the material of the coin 30. The time at which the fluctuation of the amplitude (voltage value) of the waveform signal Wc as the third sensor information piece is the latest, which relates to the diameter of the coin 30. The time at which the fluctuation of the amplitude (voltage value) of the waveform signal Wb as the second sensor information piece is between the fluctuation time of the first waveform signal Wa and that of the third waveform signal Wc, which relates to the thickness of the coin 30. In this way, the first to third sensor information pieces are analog information pieces having continuous values, and the fluctuation times of the values of these sensor information pieces are displaced with each other.

The coin discrimination operation executing system 110 conducts the authenticity discrimination and denomination discrimination of an individual coin 30 using the discrimination criterion information pieces which are set and stored in advance and the aforementioned first to third sensor information pieces (normal mode), in which the discriminable denominations are limited to the current denominations Dc. In the case where one or more additional denominations Da (e.g., D6 and D7) need to be added in addition to the current denominations Dc (e.g., D1 to D5), a new denomination adding instruction as the switching signal is sent to the coin discrimination system 100A of the coin discrimination apparatus 200 from its outside. When the operation mode switching section 115 receives the new denomination adding instruction thus sent, the section 115 switches the operation mode of the coin discrimination operation executing system 110 to the new denomination adding mode from the normal mode.

In the new denomination adding mode, the discrimination criterion information setting system 100 conducts its operations as shown in the flowchart of FIG. 12, thereby making it possible to add the discrimination criterion information pieces for the requested additional denominations Da (e.g., D6 and D7).

Here, as described above, it is supposed that the current denominations Dc are the five denominations of D1 D2, D3, D4, and D5 and the additional denominations Da to be added are the two denominations of D6 and D7. Moreover, it is supposed that each of the denominations D1, D2, D3, D4, and D5 as the current denominations Dc and each of the denominations of D6 and D7 as the additional denominations Da has 10 discrimination criterion information pieces.

In the explanation presented below, the following expression will be used.

When a current denomination is generally expressed as Dc, s current denominations can be expressed as Dc1 to Dcs, where s is a positive integer. Moreover, when each of the s current denominations Dc1 to Dcs has k discrimination criterion information pieces, the k discrimination criterion information pieces can be expressed as A1(Dc) to Ak(Dc), where k is a positive integer. More specifically, the k discrimination criterion information pieces for the current denominations Dc1 to Dcs can be expressed as A1(Dc1) to Ak(Dc1), A1(Dc2) to Ak(Dc2), A1(Dc3) to Ak(Dc3), . . . , and A1(Dcs) to Ak(Dcs).

When an additional denomination is generally expressed as Da, n additional denominations can be expressed as Da1 to Dan, where n is a positive integer. Moreover, when each of the n additional denominations Da1 to Dan has m discrimination criterion information pieces, the m discrimination criterion information pieces can be expressed as A1(Da) to Am(Da), where m is a positive integer. More specifically, the m discrimination criterion information pieces for the additional denominations Da1 to Dan can be expressed as A1(Da1) to Am(Da1), A1(Da2) to Am(Da2), A1(Da3) to Am(Da3), . . . , and A1(Dan) to Am(Dan).

When a target denomination is generally expressed as Dt, u target denominations can be expressed as Dt1 to Dtu, where u is a positive integer. Since each of the target denominations Dt is selectively designated from the current denominations Dc1 to Dcs, it is equal to any one of the current denominations Dc1 to Dcs.

Since each of the u target denominations Dt1 to Dtu has the k target denomination standard information pieces, the k target denomination standard information pieces for the u target denominations Dt1 to Dtu can be expressed as Y1(Dt1) to Yk(Dt1), Y1(Dt2) to Yk(Dt2), . . . , and Y1(Dtu) to Yk(Dtu).

Since each of the n additional denominations Da1 to Dan has the m additional denomination standard information pieces, the m additional denomination standard information pieces for the n additional denominations Da1 to Dan can be expressed as Z1(Da1) to Zm(Da1), Z1(Da2) to Zm(Da2) . . . , and Z1(Dan) to Zm(Dan).

At the start of the operation of the discrimination criterion information setting system 100, the coin discrimination operation executing system 110 is in the new denomination adding mode. At this time, the discrimination criterion information storing subsection 203*c* of the storage section 203 of the coin discrimination apparatus 200 is searched (Step S1), as shown in the flowchart of FIG. 12. Then, it is judged whether or not unregistered additional denominations exist, in other words, whether or not the m (e.g., 10) discrimination criterion information pieces A1(Da) to Am(Da) for each of the n additional denominations Da1 to Dan (e.g., two denominations D6 and D7) are set and stored in the discrimination criterion information storing subsection 203c (Step S2). These search and judgement operations are carried out by the state judging section 101 of the system 100. When it is judged that the m discrimination criterion information pieces A1(Da) to Am(Da) for each of the additional denominations Da1 to Dan are set and stored in the storing subsection 203c (i.e., unregistered additional denominations do not exist) in the Step S2, the operation flow is advanced to the Step S3 and the operation mode of the system 100 is switched to the normal mode where the series f normal or ordinary coin discrimination operations are carried out by the coin discrimination operation executing system 110. Since the new additional denomination adding mode has just begun at this stage, it is judged that the m discrimination criterion information pieces A1(Da) to Am(Da) for each of the additional denomination Da1 to Dan are not stored in the storing subsection 203c (i.e., one or more unregistered additional denominations exist) in the Step S2. As a result, the operation flow is advanced to the next Step S4.

Here, the aforementioned search of the discrimination criterion information storing subsection 203c in the step S1 and the aforementioned judgement about the presence or absence of the unregistered additional denominations in the step S2 are carried out by searching the predetermined memory areas (memory addresses) in the discrimination criterion information storing subsection 203c. Specifically, the k discrimination criterion information pieces A1(Dc) to Ak(Dc) for each of the current denominations Dc (e.g., the denominations D1 to D5) have been already set and stored respectively in the predetermined memory areas (memory addresses) of the storing section 203c at the shipment of the coin discrimination apparatus 200 (the coin depositing/dispensing apparatus 300). Moreover, the m discrimination criterion information pieces A1(Da) to Am(Da) for each of the n additional denominations Da (e.g., the denominations D6 and D7), which will be newly added after the shipment (or after starting the actual operations), are configured to be stored respectively in the predetermined dedicated memory areas (memory addresses) of the storing section 203c which are different from those of the k discrimination criterion information pieces A1(Dc) to Ak(Dc) for the current denominations Dc. For this reason, by searching the entire memory areas (memory addresses) for the m discrimination criterion information pieces A1(Da) to Am(Da) which are assigned to the n additional denominations Da, whether or not some information pieces are stored in these memory areas (memory addresses) can be known easily. Accordingly, the judgement about whether nor not the discrimination criterion information pieces A1(Da) to Am(Da) for one or more additional denominations Da are set and stored the storing section 203c can be performed.

In the next step S4, the target denomination Dt is designated. The target denomination Dt is selected and designated from the current denominations Dc. Since the target denomination Dt can be designated arbitrarily, it is supposed that the first current denomination Dc1 (i.e., the denomination D1) is designated as the target denomination Dt here. In addition, the target denomination Dt is not limited to unity but two or more target denominations Dt may be designated. In the case where two or more target denominations Dt are designated, these target denominations Dt are sequentially treated one by one while switching them alternately.

In the next step S5, the m-th discrimination criterion information piece Am(Dan) of the n-th additional denomination Dan is selected. Here, the denominations D6 and D7 are the additional denominations Da1 and Da2 and the total number of the additional denominations Da is 2 and therefore, n is an integer ranging from 1 to 2. Moreover, since the total number of the discrimination criterion information pieces for each of the additional denominations Da1 and Da2 (i.e., the denominations D6 and D7) is 10, m is an integer ranging from 1 to 10. Thus, the first and second additional denominations Da1 and Da2 are the denominations D6 and D7, respectively. In addition, the additional denomination D6 as the first additional denomination Da1 has the first to tenth discrimination criterion information pieces A1(D6) to A10(D6), and the additional denomination D7 as the second additional denomination Da2 has the first to tenth discrimination criterion information pieces A1(D7) to A10(D7). Since n=1 and m=1 at the time of performing the step p5 first, the first discrimination criterion information piece A1(D6) of the first additional denomination D6 is selected.

In the next step S6, the m-th discrimination criterion information piece Am(Dan) of the n-th additional denomination Dan which has been selected in the step S5 is calculated. Here, n=1 and m=1 and therefore, the first discrimination criterion information pieces A1(D6) of the first additional denomination D6 is calculated. This calculation operation is carried out by the additional denomination discrimination criterion information calculating section 103 of the system 100 using the following equation (1):

$$A1(D6)=A1(D1)\times C \tag{1}$$

where A1(D1) is the first discrimination criterion information piece of the current denomination D1 which is designated as the target denomination Dt and C is a coefficient given by the following equation (2):

$$C=Z1(D6)/Y1(D1) \tag{2}$$

In the equation (2), Z1(D6) is the first additional denomination standard information piece for the first additional denomination D6 and Y1(D1) is the first target denomination standard information piece of the current denomination D1 designated as the target denomination Dt.

Figure 6:
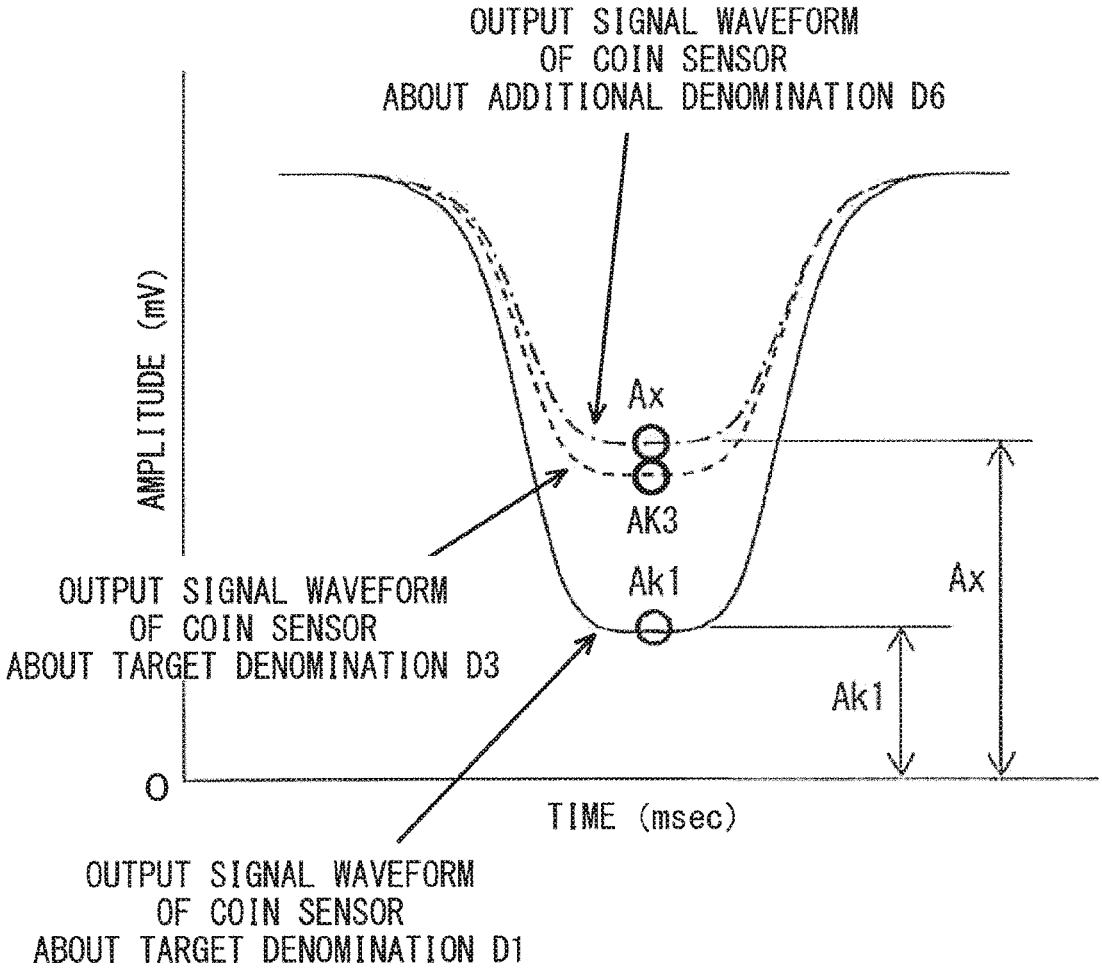
FIG. 6 is an explanatory drawing showing the relationship between the output signal waveforms that give the discrimination criterion information pieces for the target denomination and the output signal waveform that gives the discrimination criterion information piece for the additional denomination, all of which are obtained from one of the first to third coin sensors, in the discrimination criterion information setting system according to the first embodiment of the present invention shown in FIG. 2.
Figure 7:
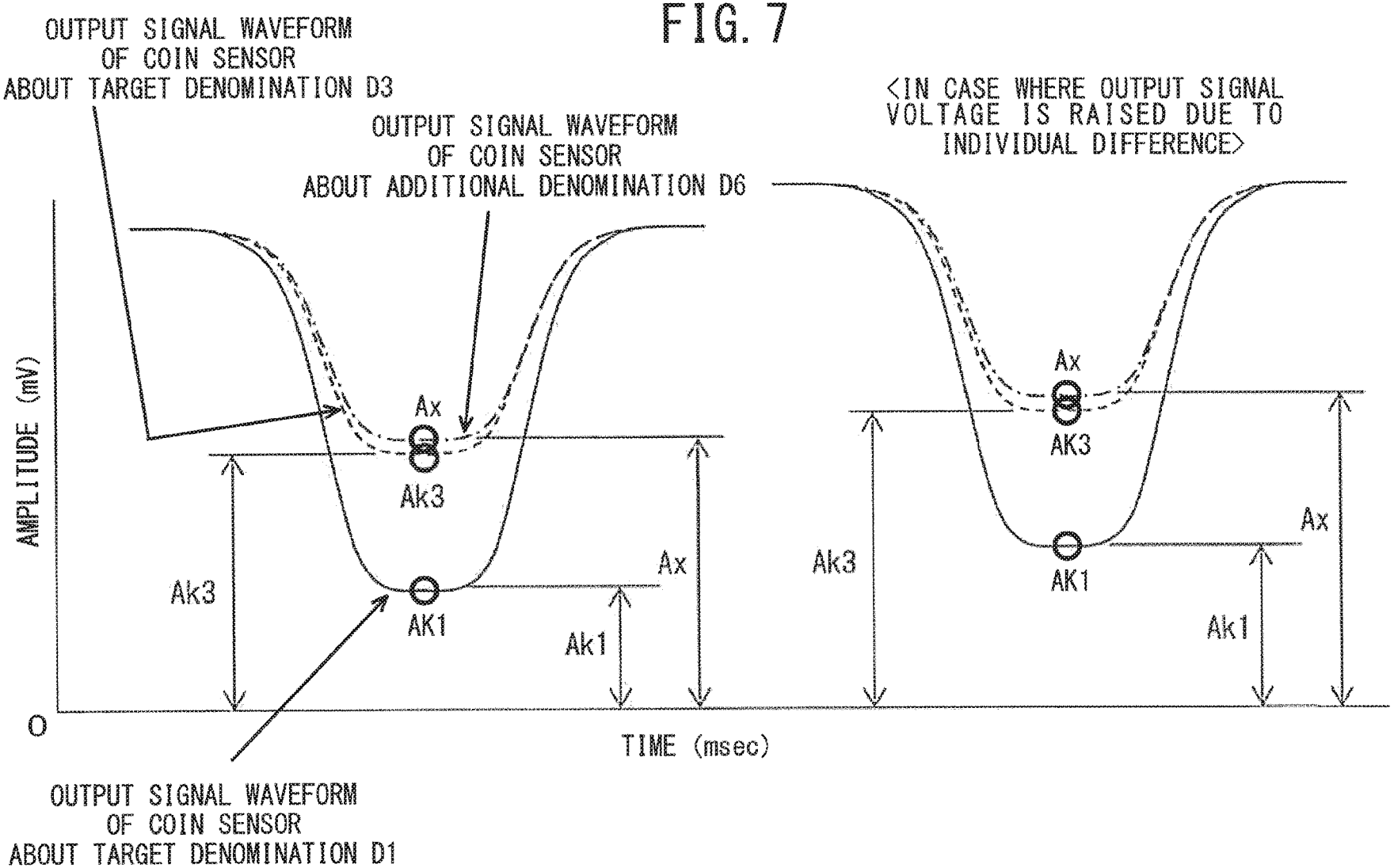
FIG. 7 is an explanatory drawing showing the relationship between the output signal waveforms that give the discrimination criterion information pieces for the target denomination and the output signal waveform that gives the discrimination criterion information piece for the additional denomination, all of which are obtained from one of the first to third coin sensors, in the discrimination criterion information setting system according to the first embodiment of the present invention shown in FIG. 2; wherein the waveforms at the time when the output voltage of the coin sensor is raised due to an individual difference of the coin discrimination apparatus and the waveforms prior to such the voltage rise are shown in comparison.

FIGS. 6 and 7 show the output signal waveforms sent from the first coin sensors 20a that detect the material of a coin 30. In FIGS. 6 and 7, the output signal waveform of the first additional denomination D6 is given by the waveform which is indicated by the dot and dash line (at the highest-positioned waveform), and the first discrimination criterion information A1D(6) of the first additional denomination D6 is given by the minimum value Ax of this waveform. The output signal waveform of the current denomination D1 as the target denomination Dt is given by the waveform which is indicated by the solid line (at the lowest-positioned waveform), and the first discrimination criterion information A1D(1) of the current denomination D1 is given by the minimum value Ak1 of this waveform. Accordingly, the relationship between the two values Ax and Ak1 is derived from the aforementioned equation (1) as follows:

$$Ax=C\times Ak1=(Ax_0/Ak1_0)\times Ak1 \tag{3}$$

In this equation (3), the first additional denomination standard information piece Z1(D6) for the first additional denomination D6 is defined as Ax_0, and the first target denomination standard information piece Y1(D1) of the current denomination D1 as the first target denomination Dt is defined as Ak1_0.

The output signal waveform indicated by the dotted line (at the middle-positioned waveform) in FIGS. 6 and 7 shows the case where the current denomination D3 is designated as the target denomination Dt instead of the current denomination D1. In this case, the first discrimination criterion information piece A1D(3) of the current denomination D3 as the target denomination Dt is given by the minimum value Ak3 of this waveform. Thus, the relationship between the two values Ax and Ak3 is given by the following equation (4):

$$Ax=C\times Ak3=(Ax_0/Ak3_0)\times Ak3 \quad (4)$$

As seen from FIGS. 6 and 7, the difference between the values Ax and Ak3 is smaller than that between the values Ax and Ak1. Thus, it is understood that the value Ax of the first discrimination criterion information piece A1D(6) of the first additional denomination D6 in the existing coin discrimination apparatus 200 in the case where the current denomination D3 is defined as the target denomination Dt has a smaller error with respect to the value in the standard apparatus of the apparatus 200 than that in the case where the current denomination D1 is defined as the target denomination Dt. This means that when designating the target denomination Dt from the current denominations D1 to D5, it is preferred to select one of the current denominations D1 to D5 in such a way that the difference between each of the discrimination information pieces A1(Dc) to Ak(Dc) of the current denomination Dc thus designated as the target denomination Dt and a corresponding one of the discrimination information pieces A1(Da) to Am(Da) of the additional denomination Da which is currently required for calculation is as small as possible.

The waveform diagram shown at the right side of FIG. 7 shows the change of the waveform in the case where the output voltage of the coin sensors is raised, which is caused by the fluctuation or dispersion due to an individual difference in coin discrimination performance of the coin discrimination apparatus 200. In this case, the value Ax of the first discrimination criterion information piece A1(D6) of the first additional denomination D6 increases with the rising output voltage of the coin sensors and as a result, the value Ax in the right-side waveform in FIG. 7 is larger than the value Ax in the left-side waveform in FIG. 7. This means that the difference between the values Ax and Ak1 is increased compared with the difference between the values Ax and Ak3. Accordingly, from this point of view also, it is understood that designating the current denomination D3 as the target denomination Dt is more preferred than designating the current denomination D1 as the target denomination Dt.

In the next step S7, the m-th discrimination criterion information piece Am(Dan) of the n-th additional denomination Dan calculated in the step S6 is stored in the discrimination criterion information storing subsection 203c. Here, since n=1 and m=1, the first discrimination criterion information A1(D6) of the first additional denomination D6 is stored in the dedicated memory area of the storing subsection 203c. Thereafter, the authenticity discriminating section 113 and the denomination discriminating section 114 of the coin discrimination operation executing system 110 are configured in such a way that the first discrimination criterion information piece A1(D6) of the first additional denomination D6 thus calculated and stored is actually used in the system 110. These storing and setting operations are carried out by the additional denomination discrimination criterion information calculating and setting sections 103 and 104 of the discrimination criterion information setting system 100, respectively.

In the next step S8, it is judged whether or not all of the discrimination criterion information pieces A1(Dan) to Am(Dan) of the n-th additional denomination Dan are stored in the discrimination criterion information storing subsection 203c. Here, since n=1 and m=10, it is judged whether or not all of the 10 discrimination criterion information pieces A1(D6) to A10(D6) of the first additional denomination D6 are stored in the storing subsection 203c. This judgement operation is carried out by the state judging section 101. Since it is judged that all of the discrimination criterion information pieces A1(D6) to A10(D6) of the first additional denomination D6 are not stored in the storing subsection 203c, the value of m is incremented by 1, in other words, the value of m is set at 2 (i.e., m=2) in the step S9. Thereafter, the operation flow is returned to the position just before the step S6 and the steps S6 to S8 are repeated.

Specifically, in the step S6, the second discrimination criterion information piece A2(D6) of the first additional denomination D6 is calculated using the aforementioned equation (1). In the step S7, the second discrimination criterion information piece A2(D6) of the first additional denomination D6 calculated in the step S6 is stored in the discrimination criterion information storing subsection 203c. Furthermore, the authenticity discriminating section 113 and the denomination discriminating section 114 are configured in such a way the second discrimination criterion information piece A2(D6) of the first additional denomination D6 thus calculated and stored is actually used in the coin discrimination execution system 110.

In the next step S8, it is judged whether or not all of the discrimination criterion information pieces A1(D6) to A10 (D6) of the first additional denomination D6 are stored in the discrimination criterion information storing subsection 203c. Since it is judged that all of the discrimination criterion information pieces A1(D6) to A10(D6) are not stored in the storing subsection 203c, the value of m is further incremented by 1, in other words, the value of m is set at 3 (i.e., m=3) in the step S9 and thereafter, the operation flow is returned to the position just before the step S6 and the steps S6 to S8 are repeated.

In the same way as described above, the steps S6 to S8 are repeated ten times and as a result, the value of m reaches 10 (i.e., m=10). At this time, it is judged that all of the discrimination criterion information pieces A1(D6) to A10 (D6) of the first additional denomination D6 are stored in the storing subsection 203c in the step S8 and thus, the operation flow is advanced to the next step S10.

In the step S10, the value of n is incremented by 1, i.e., the value of n is set at 2 (i.e., n=2) and thereafter, the operation flow is returned to the position just before the step S1 and the steps S1 to S8 are repeated.

In the step S1, the discrimination criterion information storing subsection 203c of the storage section 203 is searched again. In the next step S2, it is judged again whether or not unregistered denominations exist, in other words, whether or not the m discrimination criterion information pieces A1(Da) to Am(Da) for each of the first and second additional denominations D6 and D7 are set and stored in the storing subsection 203c. Since only the 10 discrimination criterion information pieces A1(D6) to A10 (D6) of the first additional denomination D6 have been set and stored in the storing section 203c at this stage, it is judged that unregistered additional denominations exist in the step S2. Thus, the operation flow is advanced to the next step S4.

In the step S4, the denomination D1 has been already designated as the target denomination Dt and therefore, the operation flow is advanced to the step S5. In the step S5, since n=2 and m=1, the first discrimination criterion information piece A1(D7) of the second additional denomination D7 is selected. In the next step S6, since n=2 and m=1, the first discrimination criterion information piece A1(D7) of the second additional denomination D7 is calculated using the aforementioned equation (1).

In the next step S7, the first discrimination criterion information piece A1(D7) of the second additional denomination D7 calculated in the step S6 is stored in the storing subsection 203*c*. Then, the authenticity discriminating section 113 and the denomination discriminating section 114 are configured in such a way that the first discrimination criterion information A1(D7) of the second additional denomination D7 thus calculated and stored is actually used in the system 110.

In the next step S8, it is judged whether or not all of the discrimination criterion information pieces A1(D7) to A10 (D7) of the second additional denomination D7 are stored in the discrimination criterion information storing subsection 203*c*. Since it is judged that all of the discrimination criterion information pieces A1(D7) to A10(D7) of the second additional denomination D7 are not stored in the storing subsection 203*c* at this stage, the value of m is incremented by 1, in other words, the value of m is set at 2 (i.e., m=2) in the step S9. Thereafter, the operation flow is returned to the position just before the step S6 and the steps S6 to S8 are repeated.

Specifically, in the step S6, the second discrimination criterion information piece A2(D7) of the second additional denomination D7 is calculated using the aforementioned equation (1). In the step S7, the second discrimination criterion information piece A2(D7) of the second additional denomination D7 calculated in the step S6 is stored in the storing subsection 203*c*. Furthermore, the authenticity discriminating section 113 and the denomination discriminating section 114 are configured in such a way that the second discrimination criterion information piece A2(D7) of the second additional denomination D7 thus calculated and stored is actually used in the system 110.

In the next step S8, it is judged whether or not all of the discrimination criterion information pieces A1(D7) to A10 (D7) of the second additional denomination D7 are stored in the discrimination criterion information storing subsection 203*c*. Since it is judged that all of the discrimination criterion information pieces A1(D7) to A10(D7) are not stored in the storing subsection 203*c* at this stage, the value of m is further incremented by 1, in other words, the value of m is set at 3 (i.e., m=3) in the step S9. Thereafter, the operation flow is returned to the position just before the step S6 and the steps S6 to S8 are repeated.

In the same way as above, the steps S6 to S8 are repeated 10 times in total and as a result, the value of m reaches 10 (i.e., m=10). At this time, since it is judged that all of the discrimination criterion information pieces A1(D7) to A10 (D7) of the second additional denomination D7 are stored in the storing subsection 203*c* in the step S8, the operation flow is advanced to the next step S10.

In the step S10, the value of n is incremented by 1, i.e., the value of n is set at 3 (i.e., n=3) and thereafter, the operation flow is returned to the position just before the step S1, and the steps S1 to S8 are repeated.

In the step S1, the discrimination criterion information storing subsection 203*c* of the storage section 203 is searched furthermore. In the next step S2, it is judged whether or not unregistered denominations exist, in other words, whether or not the 10 discrimination criterion information pieces A1(D6) to A10(D6) of the first additional denomination D6 and the 10 discrimination criterion information pieces A1(D7) to A10(D7) of the second additional denomination D7 are set and stored in the storing subsection 203*c*. Since the 20 discrimination criterion information pieces A1(D6) to A10(D6) and A1(D7) to A10(D7) of the first and second additional denominations D6 and D7 have been set and stored in the storing section 203*c* at this stage, it is judged that unregistered additional denominations do not exist in the step S2. As a result, the new denomination adding mode is completed, which means that the operations of the discrimination criterion information setting system 100 are stopped. At this time, the operation mode of the coin discrimination operation executing system 110 is switched to the normal mode and the normal or ordinary coin discrimination operations are started (step S3).

In addition, when it is judged that unregistered additional denominations do not exist in the step S2 and the new denomination adding mode is completed, the additional denomination discrimination criterion information setting section 104 sets the coin discrimination operation executing system 110 (the coin discrimination apparatus 200) to conduct the ordinary authentication discrimination and denomination discrimination using the calculated discrimination criterion information pieces for the additional denominations D6 and D7 thus newly registered in addition to the current denominations D1 to D5.

In the case where two or more target denominations Dt are designated from the current denominations Dc, these target denominations Dt are sequentially treated one by one while switching them alternately in the step S4. For example, the steps S1 to S10 shown in FIG. 12 are repeated while selecting one of the two or more target denominations Dt successively.

Normal Mode Operation of Coin Discrimination Operation Executing System 110

Figure 13:
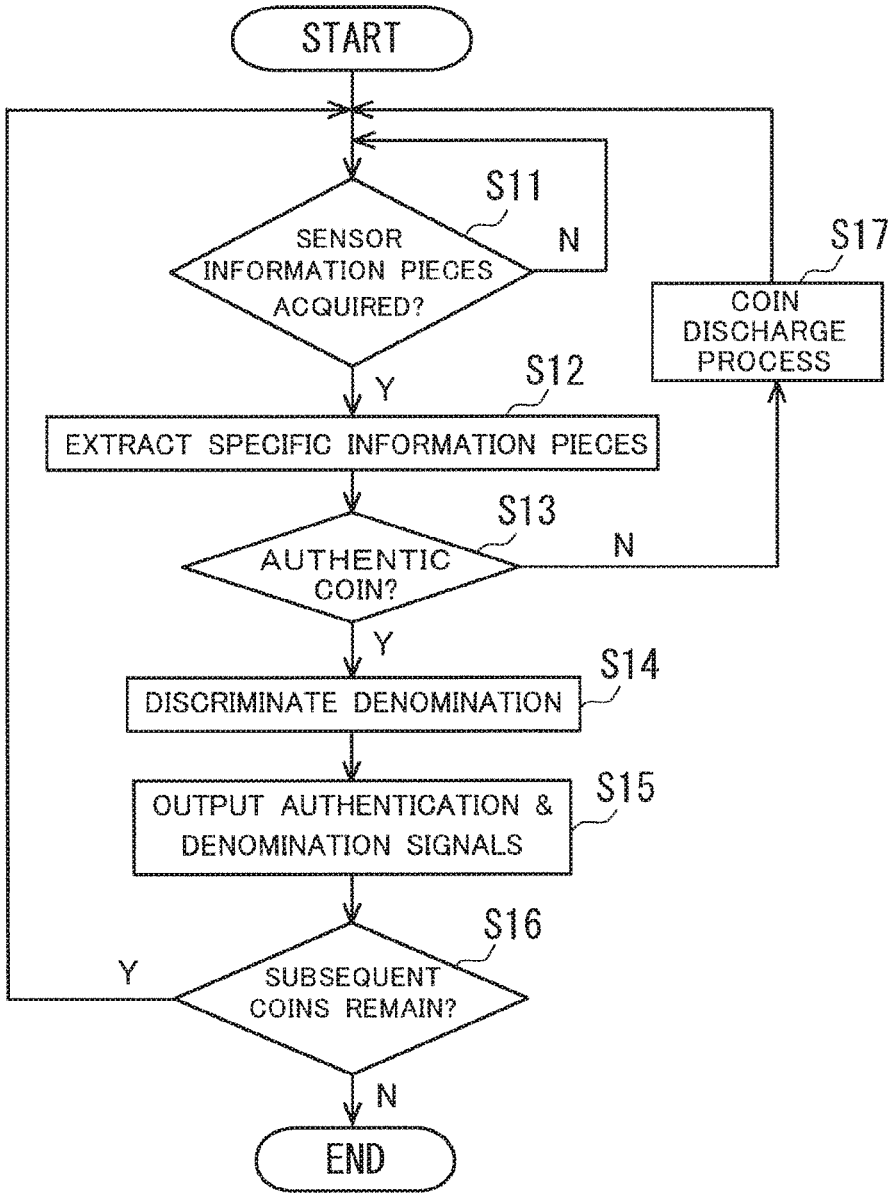
FIG. 13 is a flowchart showing the series of operations of the coin discrimination operation executing system incorporated into the control section of the coin discrimination apparatus which is built in the coin depositing/dispensing apparatus of FIG. 1.

Next, the normal mode operation of the coin discrimination operation executing system 110 will be explained. The normal mode is used for daily operation of the coin depositing/dispensing apparatus 300 and realized by the system 110. The operation flow of the system 110 is shown in FIG. 13.

First, when the arrival of a coin 30 is detected, the sensor information acquiring section 111 judges whether or not the first, second, and third sensor information pieces which are respectively outputted from the first, second, and third coin sensors 20*a*, 20*b*, and 20*c* due to the detection of the coin 30 are acquired (Step S11). When it is judged that the first to third sensor information pieces are acquired, the section 111 temporarily stores the first to third sensor information pieces thus acquired in the sensor information storing subsection 203*a* of the storage section 203. When it is judged that the first to third sensor information pieces are not acquired, the operation flow is returned to the position immediately before the step S11 and after a predetermined period passes, the same judgment as described above is carried out. In addition, the section 111 is configured to acquire automatically the first to third sensor information pieces upon their arrival to the section 111 and the judgement in the step S11 is carried out whenever a predetermined time passes. Accordingly, it may be said that the step S11 is a step of continuously awaiting the arrival of the first to third sensor information pieces.

In the next step S12, the specific information extracting section 112 reads the first to third sensor information pieces stored in the sensor information storing subsection 203*a* a little while ago and extracts the specific information pieces from the first, second, and the third sensor information pieces by a predetermined extraction method or methods. Here, each of the "specific information pieces" is an information piece which is specific to each coin 30 and which is used for coin discrimination (i.e., authenticity and denomination discriminations) of each coin 30. For example, if the predetermined extraction method is a method of "extracting the minimum value of each of the first to third sensor information pieces", the minimum voltage values of the first, second, and third sensor information pieces that fluctuate with time are extracted and the minimum voltage values thus extracted are respectively defined as the specific information pieces. In this case, the minimum values of the amplitude (voltage) of the waveform signals Wa, Wb, and Wc as the first, second, and third sensor information pieces are respectively given by the voltage values at the points A, B, and C in FIG. 5. Predetermined values other than the minimum values of the amplitude (voltage) of the waveform signals Wa, Wb, and Wc are be used as the specific information pieces according to the necessity. The specific information pieces extracted by the specific information extracting section 112 in this way are temporarily stored in the specific information storing section 203*b* of the storage section 203.

In the step S13, the authenticity discriminating section 113 reads the specific information pieces stored in the specific information storing subsection 203*b* a little while ago and the discrimination criterion information pieces previously stored in the discrimination criterion information storing subsection 203*c*, and compares respectively the specific information pieces with the discrimination criterion information pieces, thereby judging whether the currently discriminated coin 30 (which is the most recent coin 30 that has been detected by the first, second, and third coin sensors 20*a*, 20*b*, and 20*c*) is an authentic or counterfeit coin (authenticity discrimination). For example, if the specific information pieces of the currently discriminated coin 30 are respectively within the lower and upper limits of the discrimination ranges (each of which includes the lower and upper limit values) of the discrimination criterion information pieces which are set for each of the current denominations D1 to D5 and the additional denominations D6 and D7, the said coin 30 is judged authentic. If any one of the specific information pieces of the currently discriminated coin 30 is not within the discrimination ranges of the discrimination criterion information pieces which are set for each of the denominations D1 to D7, the said coin 30 is judged counterfeit. The said coin 30 thus judged counterfeit in this authenticity discrimination (i.e., the judgement in the step S13) is discharged to the outside (e.g., to the dispensing tray) of the coin depositing/dispensing apparatus 300 by way of a predetermined coin discharge process (step S17). Thereafter, the operation flow is returned to the position immediately before the step S11 and the authenticity discriminating section 113 conducts the processes of the step S11 to the step S13 with respect to a coin 30 to be discriminated next. If the coin 30 to be currently discriminated is judged authentic, the operation flow is advanced to the next step S14.

In the step S14, the denomination discriminating section 114 compares the specific information pieces which are read from the specific information storing subsection 203*b* with the discrimination criterion information pieces of each of the current denominations D1 to D5 and the additional denominations D6 and D7 which are read from the discrimination criterion information storing subsection 203*c*, thereby judging which one of the denominations D1 to D7 is identical to the denomination of the currently discriminated coin 30 (denomination discrimination). For example, if the specific information pieces of the currently discriminated coin 30 are respectively within the discrimination ranges of the discrimination criterion information pieces of one of the denominations D1 to D7, it is judged that the denomination of the said coin 30 is identical to the said one of the denominations D1 to D7. After the denomination discrimination of the said coin 30 is completed in this way, the operation flow is advanced to the step S15.

The coin 30 discriminated in the step S14 has been already judged authentic by the authenticity discriminating process in the step S13. Thus, for example, as explained in the above description about the step S13, it has been found that the specific information pieces of the said coin 30 are respectively within the discrimination ranges of the discrimination criterion information pieces of the aforementioned one of the denominations D1 to D7. Accordingly, the denomination of the said coin 30 can be quickly known from the process of the authenticity discrimination in the step S13. For this reason, it is unnecessary to respectively compare the specific information pieces which are read from the specific information storing subsection 203*b* with the discrimination criterion information pieces which are read from the discrimination criterion information storing subsection 203*c*, which results in efficiency. In this way, the authenticity discrimination in the step S13 and the denomination discrimination in the step S14 may be carried out collectively.

In this case, if any one of the specific information pieces of the currently discriminated coin 30 is not within a corresponding one of the discrimination ranges of the discrimination criterion information pieces of the denominations D1 to D7, the said coin 30 is judged counterfeit. On the contrary, if the specific information pieces of the currently discriminated coin 30 are respectively within the discrimination ranges of the discrimination criterion information pieces of one of the denominations D1 to D7, the said coin 30 is judged authentic (step S13). Moreover, it is judged that the denomination of the currently discriminated coin 30 is identical to the one of the denominations D1 to D7 where the specific information pieces of the said coin 30 are judged respectively within the discrimination ranges of the discrimination criterion information pieces thereof during this judgment process in the step S13 (step S14).

In the step S15, the authenticity discriminating section 113 outputs the authenticity signal corresponding to the authenticity discrimination result to the coin distributing section 302, and the denomination discriminating section 114 outputs the denomination signal corresponding to the denomination discrimination result to the coin distributing section 302. The coin distributing section 302 executes the distribution operation of coins 30 according to the contents of the authenticity and denomination signals thus received.

In the step S16, it is judged whether one or more coins subsequent to the currently discriminated coin 30 remain or not. If one or more subsequent coins 30 remain, the operation flow s returned to the position immediately before the step S11 and the same process of the step S11 to the step S16 is repeated with respect to each of the remaining coins 30. If one or more subsequent coins 30 do not remain, the coin discrimination process is terminated and awaits the arrival of the first to third sensor information pieces at the sensor information acquiring section 111. The judgment whether or not one or more coins subsequent to the currently discriminated coin 30 remain can be easily carried out by, for example, detecting the arrival of the first to third sensor information pieces for the one or more subsequent coins 30 by the sensor information acquiring section 111.

In the normal mode executed for daily operation of the coin depositing/dispensing apparatus 300, the aforementioned authenticity and denomination discrimination operations are carried out for the respective coins 30 to be conveyed successively by the coin discrimination operation executing system 110.

Implementation Forms

Next, the implementation or realization forms of the discrimination criterion information setting system 100 according to the first embodiment of the present invention and the coin discrimination operation executing system 110 having the aforementioned structures and functions (i.e., the coin discrimination system 100A) will be explained below.

Each of the discrimination criterion information setting system 100 and the coin discrimination operation executing system 110 may be configured by software alone or the combination of software and hardware. Each of these two systems 100 and 110 may be implemented or realized in any form if it can be incorporated into the control section 210 of the coin discrimination apparatus 200. However, it is preferred that each of the systems 100 and 110 is configured by software (i.e., firmware) only.

As shown in FIG. 16A, if the functions of the discrimination criterion information setting system 100 and those of the coin discrimination operation executing system 110 are respectively realized by software alone, the coin discrimination system 100A for controlling the coin discrimination apparatus 200 can be configured in the form of software. If the software of this system 100A is configured as firmware, this system 100A can be easily incorporated into the control section 210 of the existing coin discrimination apparatus 200. For example, this system 100A can be easily incorporated into the control section 210 by asking the administrator of the coin depositing/dispensing apparatus 300 to download the firmware of the coin discrimination system 100A by way of the Internet and to install the firmware thus downloaded to overwrite install the existing firmware in the control section 210. (The part of the control section 210 in which the firmware is stored is usually formed using a rewritable memory device such as an EEPROM and therefore, there arises no problem about such the implementation or realization form.) When the system update control section 105 is configured in such a way that the discrimination criterion information setting system 100 is automatically activated immediately to conduct the series of operations shown in FIG. 12 after the coin discrimination system 100A in the form of firmware is installed in the control section 210 of the apparatus 200 in the aforementioned way, the new denomination adding mode will be able to be automatically executed and then, the ordinary authentication and denomination discrimination operations will be able to be performed immediately after the new denomination adding mode is completed.

Alternatively, in the situation where the coin depositing/dispensing apparatus 300 is always connected to the Internet, an instruction to automatically download the firmware of the coin discrimination system 100A by way of the Internet and to automatically install the firmware thus downloaded to overwrite install the existing firmware in the control section 210 may be previously written into the system update control section 105 of the discrimination criterion information setting system 100 on the supplier side of the apparatus 300. In this case, the new denomination adding mode will be automatically executed quickly without giving the administrator trouble and the ordinary authentication and denomination discrimination operations will be carried out immediately after the new denomination adding mode is completed. This type of implementation of the coin discrimination system 100A is the easiest and most convenient.

Furthermore, the aforementioned coin discrimination system 100A may be configured as a unit or chip formed by the combination of hardware and software. In other words, the system 100A may be configured as a unit or chip as hardware into which software is written. In this case, however, delivery of the unit or chip to the users of the coin depositing/dispensing apparatus 300 will be necessary and exchange of the delivered unit or chip by the administrator or the like also will be necessary. Thus, this type of implementation is slightly inconvenient compared with the aforementioned type where the whole system 100A is formed by software, i.e., in the form of firmware.

Once the coin discrimination system 100A is incorporated into the control section 210 of the coin discrimination apparatus 200 in the existing coin depositing/dispensing apparatus 300, the updated firmware of the system 100A also will be automatically downloaded via the Internet and the updated firmware thus downloaded will be automatically installed to overwrite the existing firmware by the function of the system update control section 105 of the system 100. For this reason, even if setting of the discrimination criterion information pieces for one or more additional denominations is required after that, the setting for the one or more additional denominations thus required will be able to be carried out whenever necessary by forming the firmware of the coin discrimination system 100A in such a way as to include an instruction to automatically download a new version of the system 100A and an instruction to automatic install the new version to overwrite the existing version.

Figure 16B:
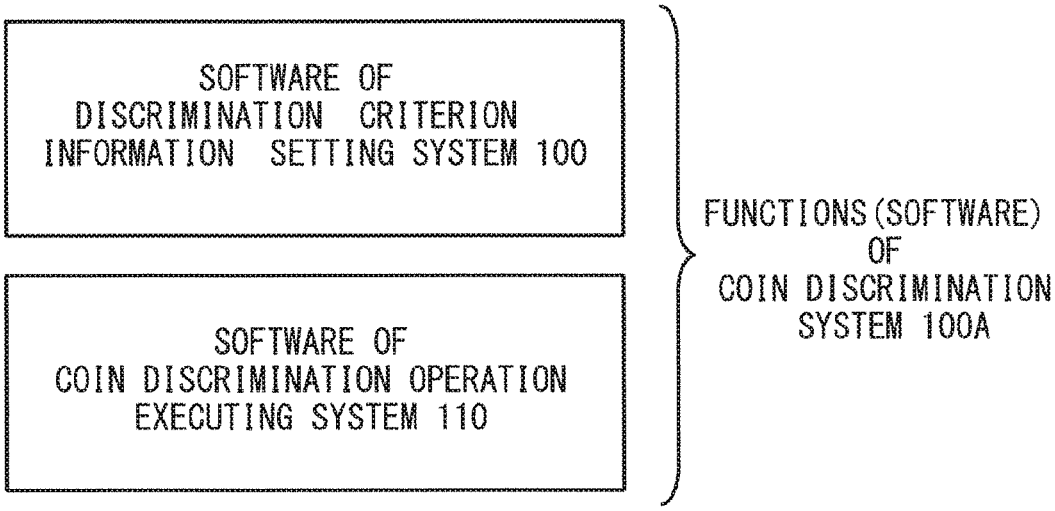
FIG. 16B is a conceptual diagram showing the configuration of the coin discrimination system in the case where software of the discrimination criterion information setting system according to the first embodiment of the present invention shown in FIG. 2 and software of the coin discrimination operation executing system are formed separately to thereby realize the functions or software of the coin discrimination system by the combination of these two pieces of software.

As shown in FIG. 16B, the discrimination criterion information setting system 100 and the coin discrimination operation executing system 110 may be separately configured by pieces of software or firmware (i.e., software or firmware pieces) to collaborate with each other, thereby realizing or implementing the functions of the coin discrimination system 100A, instead of realizing or implementing the system 100A as a single piece of software or firmware by incorporating the functions of the system 100 and those of the system 110 into single software, as shown in FIG. 16A. In the case of FIG. 16B, there arises an advantage that a "two-step installation" can be performed if, for example, the software or firmware of the discrimination criterion information setting system 100 is overwrite installed and thereafter, the software or firmware of the coin discrimination operation executing system 110 is overwrite installed. In this case, the calculation program for obtaining the discrimination criterion information pieces A1(Da) to Am(Da) for the aforementioned additional denominations Da and a set of parameter information pieces (see FIG. 15) required for executing this calculation program can be stored in the parameter information storing subsection 203*f* of the coin discrimination apparatus 200 such as the additional denomination standard information storing subsection 203*d*, the target denomination standard information storing subsection 203*e*, and/or the parameter information storing subsection 203*f* by overwrite installing the software or firmware of the discrimination criterion information setting system 100. Therefore, by successively executing the software or firmware of the system 100 thus installed, the discrimination criterion information pieces A1(Da) to Am(Da) of the aforementioned additional denominations Da can be automatically calculated and stored. The overwrite install of the software or firmware of the coin discrimination operation executing system 110 may be executed after the discrimination criterion information pieces A1(Da) to Am(Da) of the aforementioned additional denominations Da have been calculated and stored in the aforementioned way.

In addition, the discrimination criterion information setting method according to the present invention corresponds to the method executed by the aforementioned discrimination criterion information setting system 100. The computer readable medium for setting discrimination criterion information according to the present invention corresponds to a computer readable medium that stores the program for executing the said method (i.e., the discrimination criterion information setting method according to the present invention) or that implements or realizes the respective functions of the aforementioned system 100. The form of the program is not limited. The program may be configured in the form of firmware as described above or in any form other than firmware. If the program can be incorporated into the control section 210 of the coin discrimination apparatus 200, it may be formed in any type of program.

Advantages of Discrimination Criterion Information Setting System 100

With the discrimination criterion information setting system 100 according to the first embodiment of the present invention, as explained above in detail, in the coin discrimination apparatus 200 that conducts the authenticity discrimination and denomination discrimination of coins 30 using the sensor information pieces outputted from the coin sensors 20*a*, 20*b*, and 20*c*, there are provided with:

the state judging section 101 that judges whether or not the discrimination criterion information pieces A1(Da) to Am(Da) for each of the additional denominations Da (e.g., D6 and D7) are stored in the discrimination criterion information storing subsection 203*c* of the storage section 203 in which the discrimination criterion information pieces A1(Dc) to Ak(Dc) for each of the current denominations Dc (e.g., D1 to D5) are stored by searching the storing subsection 203*c;* the target denomination designating section 102 that designates the target denomination Dt from the current denominations Dc in the case where it is judged by the state judging section 101 that the discrimination criterion information pieces A1(Da) to An(Da) for the additional denominations Da are not stored;

the target denomination standard information storing subsection 203*e* that stores the target denomination standard information pieces Y1(Dt) to Yk(Dt) corresponding to the discrimination criterion information pieces A1(Dc) to Ak(Dc) for the target denomination Dt;

the additional denomination standard information storing subsection 203*d* that stores the additional denomination standard information pieces Z1(Da) to Zm(Da) corresponding to the discrimination criterion information pieces A1(Da) to An(Da) for the additional denomination Da;

the additional denomination discrimination criterion information calculating section 103 that calculates the discrimination criterion information pieces A1(Da) to An(Da) for the additional denomination Da based on the discrimination criterion information pieces A1(Dc) to Ak(Dc) for the target denomination Dt, the target denomination standard information pieces Y1(Dt) to Yk(Dt) corresponding to the discrimination criterion information pieces A1(Dc) to Ak(Dc) for the target denomination Dt, and the additional denomination standard information pieces Z1(Da) to Zm(Da) corresponding to the discrimination criterion information pieces A1(Da) to An(Da) for the additional denomination Da, and that stores the calculated discrimination criterion information pieces A1(Da) to An(Da) for the additional denomination Da in the discrimination criterion information storing subsection 203*c*; and the additional denomination discrimination criterion information setting section 104 that sets the coin discrimination apparatus 200 to conduct its authentication discrimination and denomination discrimination using the calculated discrimination criterion information pieces A1(Da) to An(Da) for the additional denomination Da.

The discrimination criterion information pieces A1(Da) to An(Da) for the additional denomination Da are calculated by (i) obtaining the standard information ratios [Y(Dt)/Z(Da)] of the target denomination standard information pieces Y1(Dt) to Yk(Dt) corresponding to the discrimination criterion information pieces A1(Dc) to Ak(Dc) for the target denomination Dt and the additional denomination standard information pieces Z1(D) to Zm(Da) corresponding to the discrimination criterion information pieces A1(Da) to An(Da) for the additional denomination Da, and (ii) multiplying the standard information ratios [Y(Dt)/Z(Da)] thus obtained by the corresponding discrimination criterion information pieces A1(Dc) to Ak(Dc) for the target denomination Dt. The standard information ratios [Y(Dt)/Z(Da)] indicate the ratios of the discrimination criterion information pieces A1(Dc) to Ak(Dc) for the target denomination Dt and the corresponding discrimination criterion information pieces A1(Da) to An(Da) for the additional denomination Da in a "standard apparatus" of the coin discrimination apparatus 200. This "standard apparatus" of the apparatus 200 is an apparatus prepared for setting the "standard information pieces" which are intended to serve as the standards for the discrimination criterion information pieces A1(Dc) to Ak(Dc) for the current denomination Dc and the discrimination criterion information pieces A1(Da) to An(Da) for the additional denomination Da at the time of initially setting the discrimination criterion information pieces A1(Dc) to Ak(Dc) and A1(Da) to An(Da) for the current and additional denominations Dc and Da in the coin discrimination apparatus 200. On the other hand, there is an analogy that the standard information ratios [Y(Dt)/Z(Da)] in the standard apparatus is kept in the coin discrimination apparatus 200 which is produced in quantity and practically operated. Accordingly, it is understood that the discrimination criterion information pieces A1(Da) to An(Da) for the additional denominations Da can be obtained by multiplication of the discrimination criterion information pieces A1(Dc) to Ak(Dc) for the target denomination Dt by the corresponding standard information ratios [Y(Dt)/Z(Da)].

The target denomination standard information pieces Y1(Dt) to Yk(Dt) are the discrimination criterion information pieces serving as the standard of the discrimination criterion information pieces A1(Dc) to Ak(Dc) of the current denomination Dc designated as the target denomination Dt and are obtained from the standard apparatus of the coin discrimination apparatus 200. The additional denomination standard information piece Z1(Da) to Zm(Da) are the discrimination criterion information pieces serving as the standard of the discrimination criterion information pieces A1(Da) to An(Da) of the additional denomination Da and are also obtained from the standard apparatus of the apparatus 200. Since it is a matter of course that the company or enterprise that manufactures the coin discrimination apparatus 200 has the standard apparatus thereof, it is easy to obtain in advance the target denomination standard information pieces Y1(Dt) to Yk(Dt) and the additional denomination standard information pieces Z1(Da) to Zm(Da), and it is easy to incorporate the target denomination standard information pieces Y1(Dt) to Yk(Dt)) and the additional denomination standard information pieces Z1(Da) to Zm(Da) thus obtained into the control program or firmware which is installed in the coin discrimination apparatus 200. Moreover, it is easy to store the aforementioned equation (1) that is used for the multiplication operation of the standard information ratios [Y(Dt)/Z(Da)] and the discrimination criterion information pieces A1(Dc) to Ak(Dc) for the target denomination Dt, the target denomination standard information pieces Y1(Dt) to Yk(Dt), and the additional denomination standard information pieces Z1(Da) to Zm(Da) in the storage section 203 of the apparatus 200. For this reason, by installing the coin discrimination system 100A as the control program or firmware in the control section 210 of the apparatus 200 and executing the same, the discrimination information pieces A1(Da) to An(Da) for the additional denomination Da are calculated and stored in the storing section 203*c*.

Accordingly, the discrimination criterion information pieces A1(Da) to An(Da) for the additional denominations Da as desired can be set in the existing coin discrimination apparatus 200 without the task of visiting the installation location of the coin discrimination apparatus 200 to exchange the existing coin discrimination system 100A incorporated in the said apparatus 200 for a new one and the task of setting the discrimination criterion information pieces A1(Da) to An(Da) for the additional denominations Da manually in the said apparatus 200. This means that the discrimination criterion information pieces A1(Da) to An(Da) for the additional denominations Da can be set by simply conducting the update operation of the coin discrimination system 100A as the control program or firmware which is incorporated into the existing apparatus 200.

Second Embodiment

Next, a discrimination criterion information setting system according to a second embodiment of the present invention will be explained below.

The structure and operations of the discrimination criterion information setting system according to the second embodiment are the same as those of the aforementioned discrimination criterion information setting system 100 according to the first embodiment except that the calculation method of the discrimination criterion information pieces for the additional denomination in the step S6 of FIG. 12 is different. Accordingly, only the different parts from the first embodiment will be explained below while omitting the explanation about the common parts with the first embodiment.

In the second embodiment, the first discrimination criterion information piece A1(06) for the first additional denomination D6 is given by the following equation (5). In this equation (5), the first additional denomination standard information piece Z1(D6) for the first additional denomination D6 is defined as Ax_0, the first target denomination standard information piece Y1(D1) for the current denomination D1 designated as the target denomination Dt is defined as Ak1_0, the voltage at the time when a coin 30 does not pass through the coin sensors 20*a*, 20*b*, and 20*c* (which is obtained in the aforementioned standard apparatus) is defined as V0_0, the voltage at the time when a coin 30 does not pass through the coin sensors 20*a*, 20*b*, and 20*c* (which is obtained in the aforementioned coin discrimination apparatus 200) is defined as V0, and the equations or relationships of V1=V0_0−Ax_0 and V2=V0_0−Ak1_0 are established.

$$Ax=V0-[(V0-Ak1)\times(V1/V2)] \tag{5}$$

Figure 8:
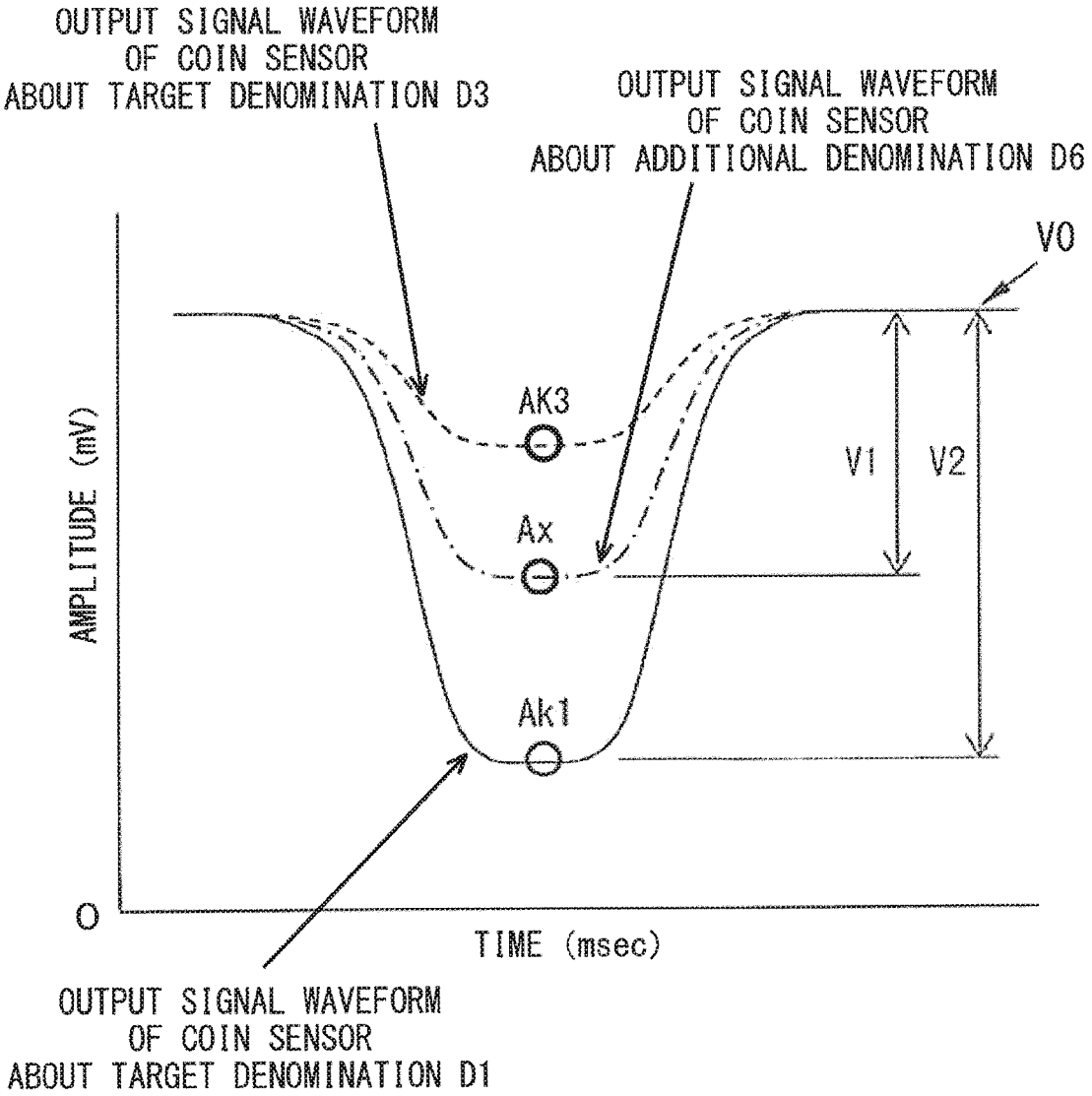
FIG. 8 is an explanatory drawing showing the relationship between the output signal waveforms that give the discrimination criterion information pieces for the target denomination and the output signal waveform that gives the discrimination criterion information piece for the additional denomination, all of which are obtained from one of the first to third coin sensors, in a discrimination criterion information setting system according to a second embodiment of the present invention.
Figure 9:
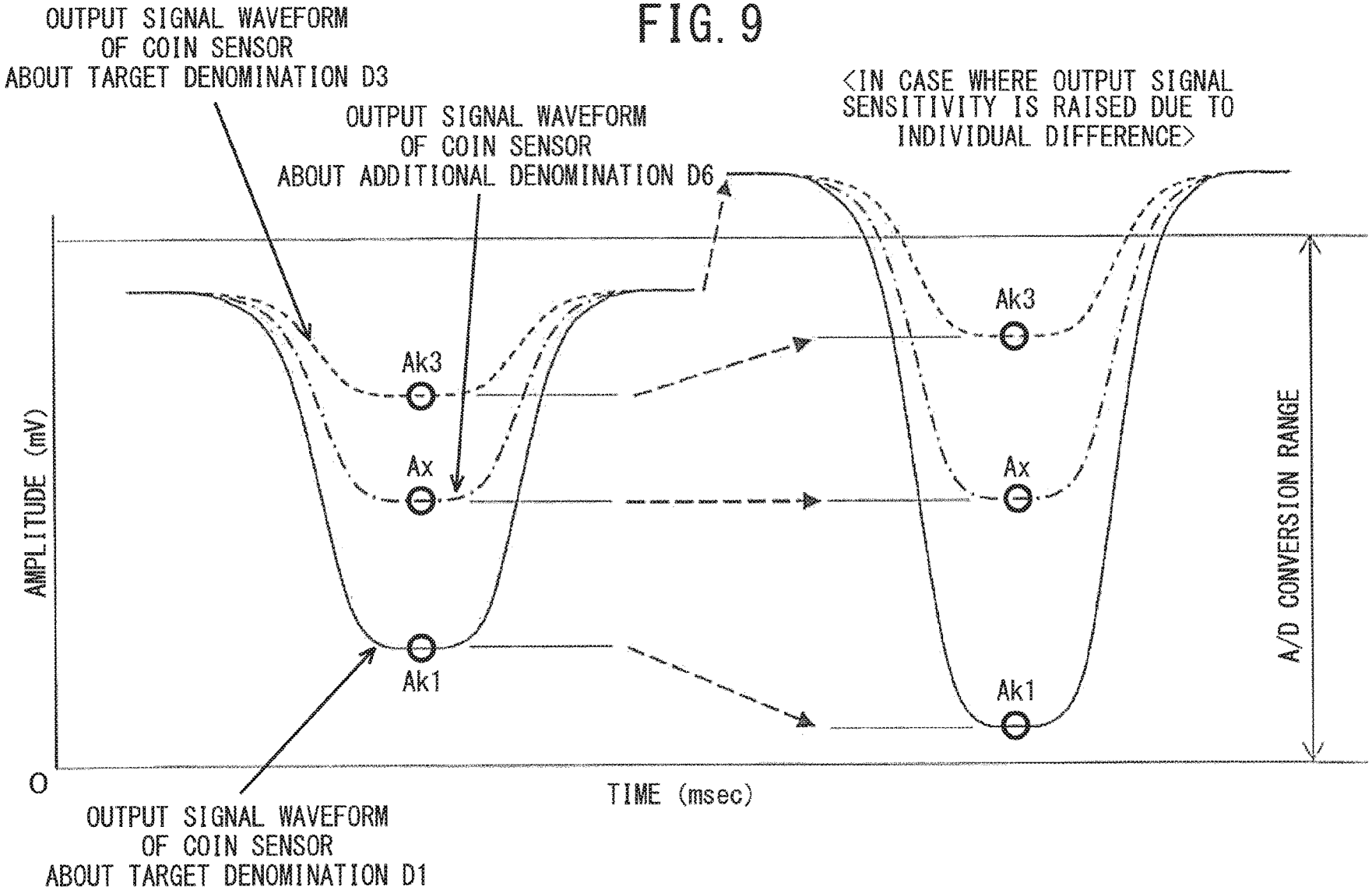
FIG. 9 is an explanatory drawing showing the relationship between the output signal waveforms that give the discrimination criterion information pieces for the target denomination and the output signal waveform that gives the discrimination criterion information piece for the additional denomination, all of which are obtained from one of the first to third coin sensors, in the discrimination criterion information setting system according to the second embodiment of the present invention; wherein the waveforms at the time when the sensitivity of the coin sensor is raised in the coin discrimination apparatus and the waveforms prior to such the sensitivity rise are shown in comparison.

FIGS. 8 and 9 show the output signal waveforms sent from the first coin sensors 20*a* that detect the material of a coin 30 in the second embodiment. In FIGS. 8 and 9, the output signal waveform of the first additional denomination D6 is given by the waveform which is indicated by the dot and dash line (at the middle-positioned waveform), and the first discrimination criterion information piece A1D(6) for the first additional denomination D6 is given by the minimum value Ax of this waveform. The output signal waveform of the current denomination D1 designated as the target denomination Dt is given by the waveform which is indicated by the solid line (at the lowest-positioned waveform), and the first discrimination criterion information piece A1D (1) for the current denomination D1 is given by the minimum value Ak1 of this waveform. The output signal waveform of the current denomination D3 when it is designated as the target denomination Dt is given by the waveform which is indicated by the dotted line (at the highest-positioned waveform), and the first discrimination criterion information piece A1D(1) for the current denomination D3 is given by the minimum value Ak3 of this waveform.

The waveform diagram shown at the right side of FIG. 9 shows the change of the waveforms in the case where the sensitivity of the coin sensors is raised, which is caused by the fluctuation or dispersion due to an individual difference. In this case, the value Ax of the first discrimination criterion information piece A1(D6) for the first additional denomination D6 scarcely changes with the rising sensitivity of the coin sensors and as a result, the value Ax in the right-side waveform in FIG. 9 is approximately equal to the value Ax in the left-side waveform in FIG. 9. Unlike this, the value Ak1 of the first discrimination criterion information piece A1(D1) for the current denomination D1 decreases largely and the value Ak3 of the first discrimination criterion information piece A1(D3) of the current denomination D3 increases largely. Since the value Ak3 of the first discrimination criterion information piece A1(D3) for the current denomination D3 is likely to go beyond the A/D (analog-to-digital) conversion range in which the A/D conversion of the discrimination criterion information pieces for the current and additional denominations Dc and Da can be performed, it is understood that the current denomination D3 cannot be designated as the target denomination Dt. On the other hand, the current denomination D1 can be designated as the target denomination Dt; however, the value Ak1 of the first discrimination criterion information piece A1(D1) for he current denomination D1 is largely shifted from the value Ax of the first discrimination criterion information piece A1(D6) for the first additional denomination D6. Thus, it is understood that designation of the current denomination D1 as the target denomination Dt is not preferred also.

With the discrimination criterion information setting system according to the second embodiment, since the calculation method includes the aforementioned equation (5), the effect of the sensitivity fluctuation of the coin sensors 20*a*, 20*b*, and 20*c* caused by the fluctuation or dispersion due to an individual difference can be reduced compared with the first embodiment where the calculation method including the aforementioned equation (3) or (4) is used. This is because the voltage V1 given by the equation of V1=V0_0−Ax_0 and the voltage V2 given by the equation of V2=V0_0−Ak1_0 are used in the equation (5) in addition to the voltage V0_0 at the time when a coin 30 does not pass through the coin sensors 20*a*, 20*b*, and 20*c* (i.e., the standard voltage) which is obtained in the aforementioned standard apparatus, and the voltage V0 at the time when a coin 30 does not pass through the coin sensors 20*a*, 20*b*, and 20*c* which is obtained in the aforementioned coin discrimination apparatus 200. This means that the value Ax of the first discrimination criterion information piece A1D(6) for the first additional denomination D6 is calculated using the voltages V0_0 and V0 at the time when a coin 30 does not pass through the coin sensors 20*a*, 20*b*, and 20*c* as the reference instead of using the 0 voltage as the reference as shown in the first embodiment.

With the discrimination criterion information setting system according to the second embodiment, it is preferred to store in advance a set of parameter information pieces such as Ak1 and (V1/V2) which are used for calculating the discrimination criterion information pieces for the additional denominations D6 and D7 (the denomination Nos. of which are 6 and 7) in the parameter information storing subsection 203*f* in such a way as to have a format or layout shown in FIG. 15. In this case, there is an additional advantage that the discrimination criterion information pieces for the additional denominations D6 and D7 can be calculated more quickly compared with the case where such these parameter information pieces as above are not used.

Moreover, it is preferred that plural sets of parameter information pieces shown in FIG. 15 which are prepared for the different calculation methods are stored together in advance in the parameter information storing subsection 203*f*. This is because the different calculation methods such as those used in the first and second embodiments can be selectively used according to the circumstances, which makes it possible to cope with various situations with flexibility and to result in more convenience.

Third Embodiment

Next, a discrimination criterion information setting system according to a third embodiment of the present invention will be explained below.

The structure and operations of the discrimination criterion information setting system according to the third embodiment are the same as those of the aforementioned discrimination criterion information setting system 100 according to the first embodiment except that the calculation method of the discrimination criterion information pieces for the additional denomination in the step S6 of FIG. 12 is different. Accordingly, only the different parts from the first embodiment will be explained below while omitting the explanation about the common parts with the first embodiment.

In the third embodiment, the first discrimination criterion information piece A1(D6) for the first additional denomination D6 is given by the following equation (6). In the equation (6), the first additional denomination standard information piece Z1(D6) for the first additional denomination D6 is defined as Ax_0, the first target denomination standard information piece Y1(D1) for the current denomination D1 designated as the target denomination Dt is defined as by Ak1_0, the first target denomination standard information piece Y1(D2) for the current denomination D2 designated as the target denomination Dt is defined as Ak2_0, and the equations or relationships of V3=Ax_0−Ak1_0 and V4=Ak2_0−Ak1_0 are established.

$$Ax=[(Ak2-Ak1)\times(V3/V4)]+Ak1 \quad (6)$$

Figure 10:
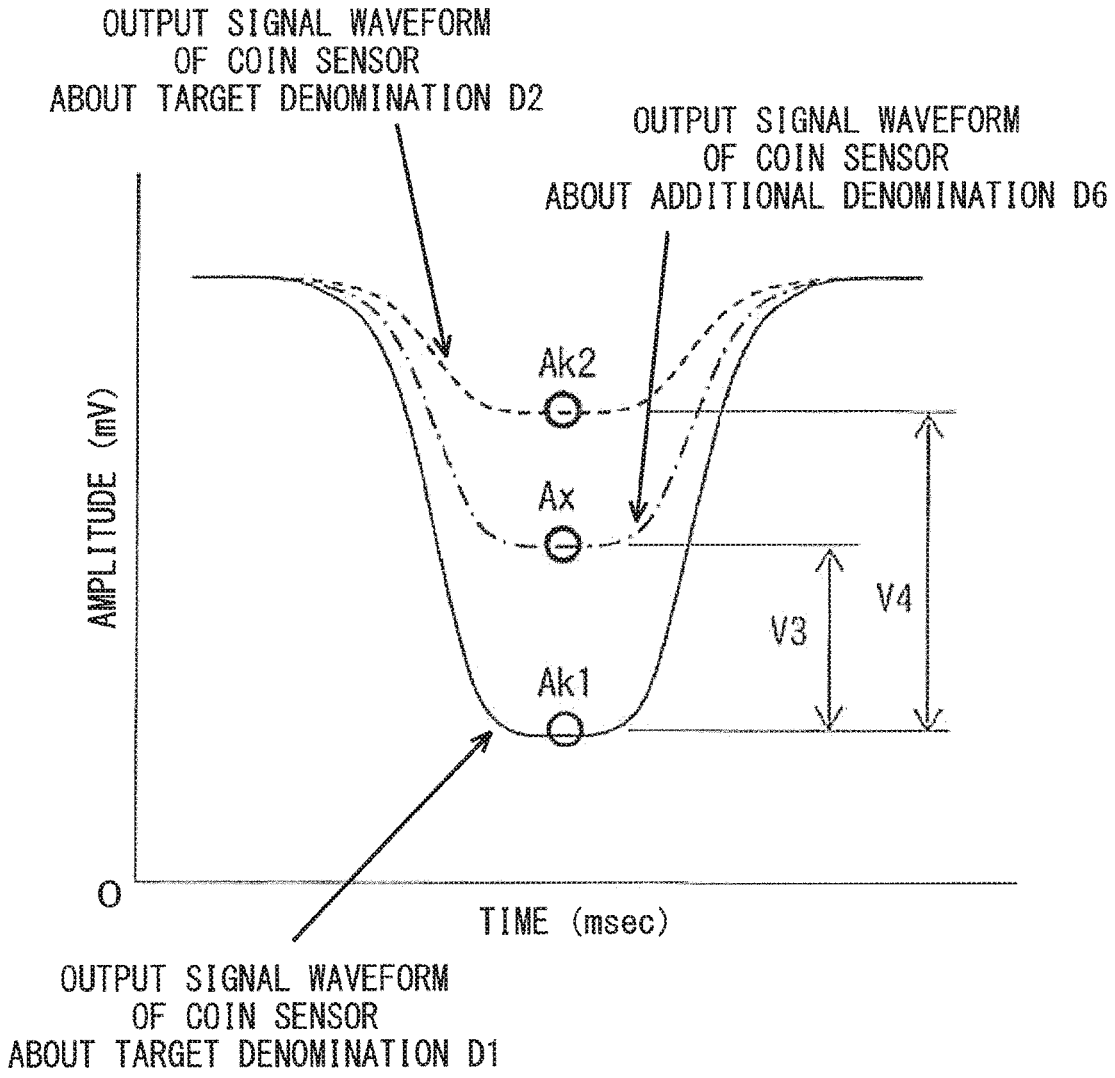
FIG. 10 is an explanatory drawing showing the relationship between the output signal waveforms that give the discrimination criterion information pieces for the target denomination and the output signal waveform that gives the discrimination criterion information piece for the additional denomination, all of which are obtained from one of the first to third coin sensors, in a discrimination criterion information setting system according to a third embodiment of the present invention.
Figure 11:
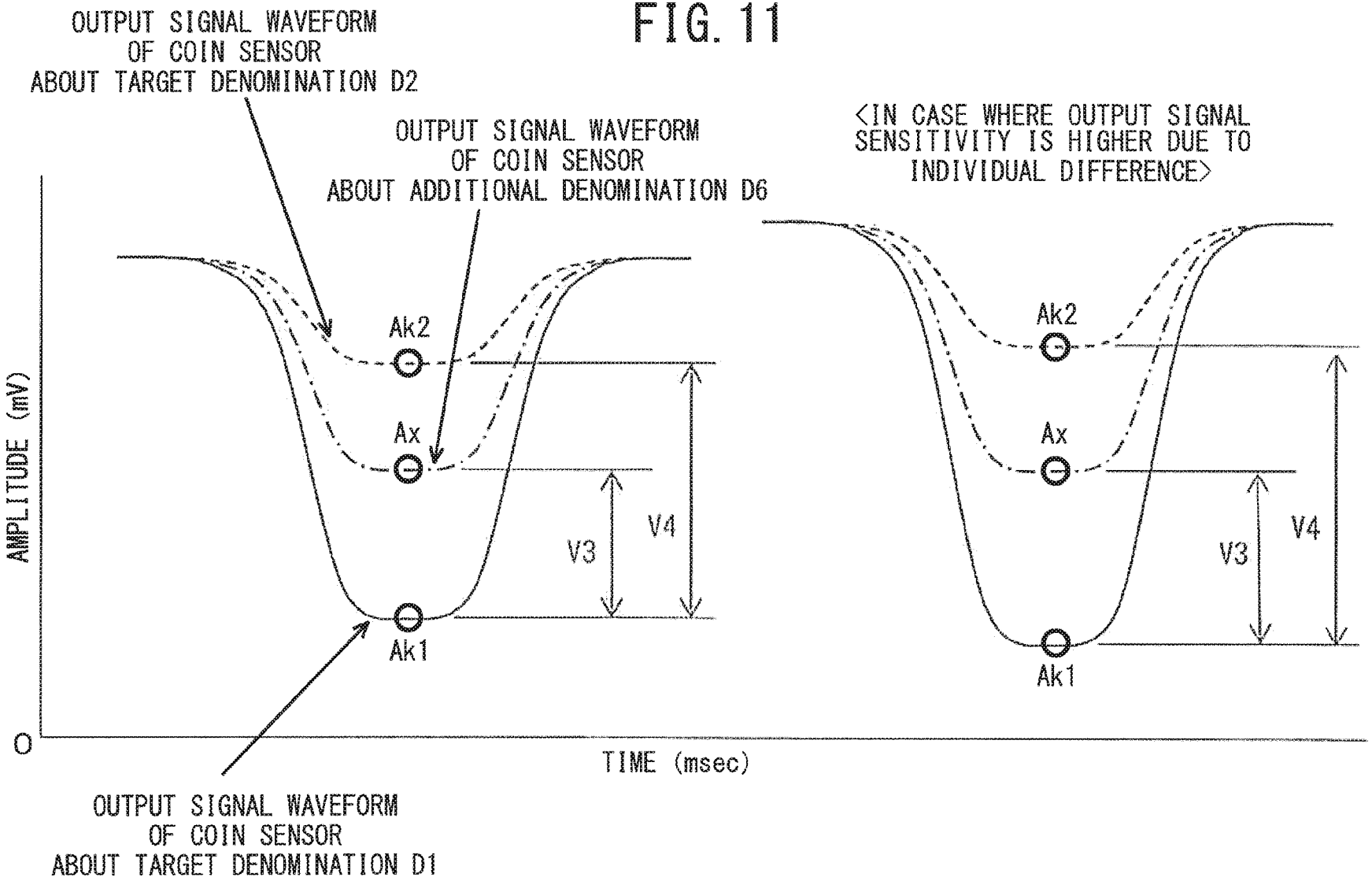
FIG. 11 is an explanatory drawing showing the relationship between the output signal waveforms that give the discrimination criterion information pieces for the target denomination and the output signal waveform that gives the discrimination criterion information piece for the additional denomination, all of which are obtained from one of the first to third coin sensors, in the discrimination criterion information setting system according to the third embodiment of the present invention; wherein the waveforms at the time when the sensitivity of the coin sensor is higher due to individual variation of the coin discrimination apparatus and the waveforms without such the sensitivity rise are shown in comparison.

FIGS. 10 and 11 show the output signal waveforms sent from the first coin sensors 20*a* that detect the material of a coin 30 in the third embodiment. In FIGS. 10 and 11, the output signal waveform of the first additional denomination D6 is given by the waveform which is indicated by the dot and dash line (at the middle-positioned waveform), and the first discrimination criterion information piece A1D(6) for the first additional denomination D6 is given by the minimum value Ax of this waveform. The output signal waveform of the current denomination D1 designated as the target denomination Dt is given by the waveform which is indicated by the solid line (at the lowest-positioned waveform), and the first discrimination criterion information piece A1(D1) for the current denomination D1 is given by the minimum value Ak1 of this waveform. The output signal waveform of the current denomination D2 when it is designated as the target denomination Dt is given by the waveform which is indicated by the dotted line (at the highest-positioned waveform), and the first discrimination criterion information A1(D2) for the current denomination D2 is given by the minimum value Ak2 of this waveform.

The waveform diagram shown at the right side of FIG. 11 shows the change of the waveforms in the case where the sensitivity of the coin sensors is made higher, which is caused by the fluctuation or dispersion due to an individual difference. In this case, the value Ax of the first discrimination criterion information piece A1(D6) for the first additional denomination D6 scarcely changes with the rising sensitivity of the coin sensors and as a result, the value Ax in the right-side waveform in FIG. 11 is approximately equal to the value Ax in the left-side waveform in FIG. 11. Unlike this, the value Ak1 of the first discrimination criterion information piece A1(D1) for the current denomination D1 decreases slightly and the value Ak2 of the first discrimination criterion information piece A1(D2) for the current denomination D2 increases slightly. For this reason, any one of the value Ak1 of the first discrimination criterion information piece A1(D1) for the current denomination D1 and the value Ak2 of the first discrimination criterion information piece A1(D2) for the current denomination D2 can be designated as the target denomination Dt.

With the discrimination criterion information setting system according to the third embodiment, since the calculation method includes the aforementioned equation (6), the effect of the sensitivity fluctuation of the coin sensors 20*a*, 20*b*, and 20*c* which is caused by the fluctuation or dispersion due to an individual difference can be reduced compared with the first embodiment where the calculation method including the aforementioned equation (3) or (4) is used and the second embodiment where the calculation method including the aforementioned equation (5) is used. This is because the value Ax of the first discrimination criterion information piece A1D(6) for the first additional denomination D6 is calculated using the difference between the said value Ax and the value Ak1 of the first discrimination criterion information piece A1(D1) for the current denomination D1 and the difference between the said value Ax and the value Ak2 of the first discrimination criterion information piece A1(D2) for the current denomination D2. Since these two differences fluctuate (i.e., increase or decrease) in the same or a similar way according to the sensitivity fluctuation of the coin sensors 20*a*, 20*b*, and 20*c*, it is difficult for the difference between the values Ax and Ak1 and the difference between the values Ax and Ak2 to have a large difference.

With the discrimination criterion information setting system according to the third embodiment also, it is preferred to store in advance a set of parameter information pieces such as Ak1, Ak2, and (V3/V5) which are used for calculating the discrimination criterion information pieces of the additional denominations D6 and D7 (the denomination Nos. of which are 6 and 7) in the parameter information storing subsection 203*f* in such a way as to have a format or layout shown in FIG. 15. In this case, there is an additional advantage that the discrimination criterion information pieces for the additional denominations D6 and D7 can be calculated more quickly compared with the case where these parameter information pieces are not used.

Moreover, it is preferred that plural sets of parameter information pieces shown in FIG. 15 which are prepared for the different calculation methods are stored together in advance in the parameter information storing subsection 203*f*. This is because the different calculation methods such as those used in the first to third embodiments can be selectively used according to the circumstances, which makes it possible to cope with various situations with flexibility and to result in more convenience.

Modifications

The aforementioned first to third embodiments are exemplary embodied examples of the present invention. Thus, it is needless to say that the present invention is not limited to these embodiments and any other modification is applicable to the embodiments without departing the spirit of the invention.

For example, in the aforementioned first to third embodiments, the first, second, and third coin sensors 20*a*, 20*b*, and 20*c* detect the material, thickness, and diameter of coins 30, respectively; however, the present invention is not limited to this. The total number of the coin sensors may be changed according to the necessity. For example, if the range of the diameter of coins 30 to be discriminated is wide, a plurality (or plural pairs) of diameter sensors need to be used; this is similarly applicable to the case where the range(s) of the material and/or thickness of coins 30 to be discriminated is/are wide. If any character or property of coins 30 other than the material, thickness, and diameter needs to be detected, the total number of the coin sensors will be increased according to the necessity such as a fourth coin sensor or sensors, a fifth coin sensor or sensors and so on. The present invention covers all these cases, in which no limitation is applied to the total number of coin sensors.

Moreover, in the aforementioned first to third embodiments, the total number of the discrimination criterion information pieces for each current or additional denomination is set at 10; however, the present invention is not limited to this. The total number of the discrimination criterion information pieces for each current or additional denomination may be set at any number according to the necessity for coin discrimination.

INDUSTRIAL APPLICABILUTY

The method, system, and computer readable medium for setting the discrimination criterion information according to the present invention are applicable not only to coins as currency but also coin equivalents such as token and medals.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A method for setting discrimination criteria for an additional denomination not currently stored in a coin discrimination apparatus that conducts authenticity discrimination and denomination discrimination of coins using sensor information outputted from coin sensors in addition to discrimination criteria for each of current denominations in the coin discrimination apparatus, the method comprising:

determining whether the discrimination criteria for the additional denomination are stored in a discrimination criteria storing device of the coin discrimination apparatus in which the discrimination criteria for each of the current denominations are stored;

designating a target denomination from the current denominations when it is determined that the discrimination criteria for the additional denomination are not stored;

calculating the discrimination criteria for the additional denomination by multiplying discrimination criteria for the target denomination by ratios between target denomination standards to be complied with by discrimination criteria for the target denomination when setting the discrimination criteria for the current denomination designated as the target denomination using a standard apparatus for setting the target denomination standards for the coin discrimination apparatus by its manufacturer, and obtained by conducting the authenticity discrimination and denomination discrimination of coins having the target denomination using the standard apparatus, and additional denomination standards to be complied with by discrimination criteria for the additional denomination when setting the discrimination criteria for the additional denomination using the standard apparatus for setting the additional denomination standards for the coin discrimination apparatus by its manufacturer, and obtained by conducting the authenticity discrimination and denomination discrimination of coins having the additional denomination using the standard apparatus;

storing the calculated discrimination criteria for the additional denomination in the discrimination criteria storing device;

setting the coin discrimination apparatus to conduct authentication discrimination and denomination discrimination using the calculated discrimination criteria for the additional denomination, wherein when the discrimination criteria for the additional denomination are calculated by multiplying the ratios by the discrimination criteria for the target denomination, two or more calculation methods are selectively used, each of the two or more calculation methods obtains the discrimination criteria for the additional denomination by applying predetermined parameters
to
a predetermined equation, and
one of the two or more calculation methods is selectively used to reduce an effect of a fluctuation of
the coin discrimination performance of the coin discrimination apparatus
from
the coin discrimination performance of the standard apparatus;

switching the coin discrimination apparatus
from a normal mode in which the coin discrimination apparatus performs coin discriminating operations for discriminating the authenticity and denomination of a coin from discrimination criteria for the current denominations,
to a new denomination adding mode for determining whether the additional-denomination discrimination criteria are stored in the coin discrimination apparatus and for calculating the additional-denomination discrimination criteria in the event the additional-denomination discrimination criteria are not stored in the coin discrimination apparatus by performing the determining, designating, calculating, storing, and setting operations; and automatically switching the coin discrimination apparatus from the new denomination adding mode to the normal mode when the operations performed in the new denomination adding mode are completed, wherein the target denomination is designated by selecting the current denomination that produces the smallest difference when calculating the difference between
a specific information piece or a value that is extracted from the output signal waveform of each current denomination from a respective coin sensor of the coin sensors and
a specific information piece or a corresponding value that is extracted from the output signal waveform of the additional denomination from a corresponding coin sensor of the coin sensors.

2. The method according to claim 1, wherein it is determined whether or not two or more of the target denominations can be designated from the current denominations, and when two or more of the target denominations can be designated from the current denominations, the two or more of the target denominations are selectively used in such a way that differences in value between one of the target denomination standards for each of the two or more of the target denominations and a corresponding one of the additional denomination standards are as small as possible.

3. The method according to claim 1, wherein two or more of the target denominations are designated from the current denominations, and one of the target denomination standards for each of the two or more of the target denominations is used for calculating the discrimination criteria for the additional denomination.

4. The method according to claim 1, wherein in a case where it is required to set the discrimination criteria for two or more of the additional denominations at one time, two or more of the target denominations are switchably designated when calculating the discrimination criteria for each of the two or more of the additional denominations.

5. The method according to claim 1, wherein a single software component (a) stores the target denomination standards and the additional denomination standards in the coin discrimination apparatus using the target denomination which is designated in advance, (b) calculates the discrimination criteria for the additional denomination by multiplying the ratios by the discrimination criteria for the target denomination, (c) stores the calculated discrimination criteria for the additional denomination in the discrimination criteria storing device, and (d) sets the coin discrimination apparatus to conduct authentication discrimination and denomination discrimination using the calculated discrimination criteria for the additional denomination.

6. The method according to claim 1, wherein:

the discrimination criteria for the target denomination are given by amplitudes of a first set of waveforms that vary according to the sensor information;

the discrimination criteria for the additional denomination are given by amplitudes of a second set of waveforms that vary according to the sensor information;

the target denomination standards are given by amplitudes of a third set of waveforms that vary according to the sensor information;

the additional denomination standards are given by amplitudes of a fourth set of waveforms that vary according to the sensor information; and a relationship between the amplitudes that give the discrimination criteria for the target denomination and the amplitudes that give the discrimination criteria for the additional denomination is given by a relationship between the target denomination standards and the additional denomination standards.

7. The method according to claim 1, wherein the discrimination criteria for the additional denomination include information relating to a material of the coins, information relating to a thickness of the coins, and information relating to a diameter of the coins; and when the information relating to the diameter of the coins is calculated, one of the current denominations that has a nearest diameter to the additional denomination is designated as the target denomination.

8. The method according to claim 1, further comprising:

receiving a predetermined external switching signal representing an instruction to store the discrimination criteria for the additional denomination; and automatically switching, in response to receiving the predetermined external switching signal, the coin discrimination apparatus from the normal mode to the new denomination adding mode.

9. The method according to claim 1, wherein the output signal waveforms of two of the current denominations from two respective coin sensors of the coin discrimination apparatus are higher than the output signal waveforms of the two current denominations from the respective coin sensors of the standard apparatus, and based on the higher output signal waveforms, the target denomination is designated by selecting the current denomination that produces the smallest difference when calculating the difference between the specific information piece or a value that is extracted from the output signal waveform of each current denomination from a respective coin sensor of the coin sensors and a specific information piece or a corresponding value that is extracted the output signal waveform of the additional denomination from a corresponding coin sensor of the coin sensors.

10. The method according to claim 1, wherein the output signal waveform of a first current denomination from a respective coin sensor of the coin discrimination apparatus is higher than the output signal waveform of the first current denomination from a respective coin sensor of the standard apparatus, the output signal waveform of a second current denomination from a respective coin sensor of the coin discrimination apparatus is lower than the output signal waveform of the second current denomination from a respective coin sensor of the standard apparatus, the target denomination is designated by selecting the current denomination that produces the smallest difference when calculating the difference between the minimum value of the output signal waveform of each current denomination from a respective coin sensor of the coin sensors and the minimum value of the output signal waveform of the additional denomination from a corresponding coin sensor of the coin sensors, but if the higher output signal waveform of the first current denomination is higher than a predetermined amount, the first current denomination is not used in the target-denomination designation operation, and if the lower output signal waveform of the second current denomination from the coin discrimination apparatus is sufficiently lower than the output signal waveform of the second current denomination from the standard apparatus, then the second current denomination is not preferred to be designated as the target denomination.

11. The method according to claim 1, wherein the output signal waveform of a first current denomination from a respective coin sensor of the coin discrimination apparatus is higher than the output signal waveform of the first current denomination from a respective coin sensor of the standard apparatus, the output signal waveform of a second current denomination from a respective coin sensor of the coin discrimination apparatus is lower than the output signal waveform of the second current denomination from a respective coin sensor of the standard apparatus, the output signal waveform of the additional denomination from a respective coin sensor of the coin discrimination apparatus is approximately the same as the output signal waveform of the additional denomination from a respective coin sensor of the standard apparatus, the target denomination is designated by selecting the current denomination that produces the smallest difference when calculating the difference between the minimum value of the output signal waveform of each current denomination from a respective coin sensor of the coin sensors and the minimum value of the output signal waveform of the additional denomination from a corresponding coin sensor of the coin sensors, the higher output signal waveform of the first current denomination and the lower output signal waveform of the second current denomination are not sufficiently high and low, respectively, so as to disqualify the first and second denominations from use in the target-denomination designation operation.

12. A system for setting discrimination criteria for an additional denomination not currently stored in a coin discrimination apparatus that conducts authenticity discrimination and denomination discrimination of coins using sensor information outputted from coin sensors in addition to discrimination criteria for each of current denominations in the coin discrimination apparatus, the system comprising:

a state-determining controller configured to determine whether the discrimination criteria for the additional denomination are stored in a discrimination-criteria-storing device of the coin discrimination apparatus in which the discrimination criteria for each of the current denominations are stored;

a target-denomination-designating controller configured to designate a target denomination from the current denominations when it is determined that the discrimination criteria for the additional denomination are not stored in the discrimination-criteria-storing device;

an additional-denomination-discrimination-criteria-calculating controller configured to calculate the discrimination criteria for the additional denomination by multiplying discrimination criteria for the target denomination by ratios between target denomination standards to be complied with by discrimination criteria for the target denomination when setting the discrimination criteria for the current denomination designated as the target denomination using a standard apparatus for setting the target denomination standards for the coin discrimination apparatus by its manufacturer, and obtained by conducting the authenticity discrimination and denomination discrimination of coins having the target denomination using the standard apparatus, and additional denomination standards to be complied with by discrimination criteria for the additional denomination when setting the discrimination criteria for the additional denomination using the standard apparatus for setting the additional denomination standards for the coin discrimination apparatus by its manufacturer, and obtained by conducting the authenticity discrimination and denomination discrimination of coins having the additional denomination using the standard apparatus;

an additional-denomination-discrimination-criteria-storing controller configured to store the calculated discrimination criteria for the additional denomination in the discrimination-criteria-storing device;

an additional-denomination-discrimination-criteria-setting controller configured to set the coin discrimination apparatus to conduct authentication discrimination and denomination discrimination using the calculated discrimination criteria for the additional denomination, wherein when the additional-denomination-discrimination-criteria-calculating controller calculates the discrimination criteria for the additional denomination by multiplying the ratios by the discrimination criteria for the target denomination, additional-denomination-discrimination-criteria-calculating controller selectively uses two or more calculation methods, each of the two or more calculation methods obtains the discrimination criteria for the additional denomination by applying predetermined parameters
to
a predetermined equation, and the additional-denomination-discrimination-criteria-calculating controller selectively uses one of the two or more calculation methods to reduce an effect of a fluctuation of
the coin discrimination performance of the coin discrimination apparatus
from
the coin discrimination performance of the standard apparatus;

a switching controller configured to switch the coin discrimination apparatus
from a normal mode in which the coin discrimination apparatus performs coin discriminating operations for discriminating the authenticity and denomination of a coin from discrimination criteria for the current denominations,
to a new denomination adding mode for determining whether the additional-denomination discrimination criteria are stored in the coin discrimination apparatus and for calculating the additional-denomination discrimination criteria in the event the additional-denomination discrimination criteria are not stored in the coin discrimination apparatus by performing the determining, designating, calculating, storing, and setting operations, the switching controller also being configured to automatically switch the coin discrimination apparatus from the new denomination adding mode to the normal mode when the operations performed in the new denomination adding mode are completed, wherein the target-denomination-designating controller designating the target denomination by selecting the current denomination that produces the smallest difference when calculating the difference between
a specific information piece or a value that is extracted from the output signal waveform of each current denomination from a respective coin sensor of the coin sensors and
a specific information piece or a corresponding value that is extracted from the output signal waveform of the additional denomination from a corresponding coin sensor of the coin sensors.

13. The system according to claim 12, wherein the target-denomination-designating controller has a configuration designating two or more of the target denominations from the current denominations, and
when two or more of the target denominations are designated from the current denominations, the two or more of the target denominations are selectively used in such a way that differences in value between one of the target denomination standards for each of the two or more of the target denominations and a corresponding one of the additional denomination standards are as small as possible in the additional denomination discrimination criterion information calculating controller.

14. The system according to claim 12, wherein the target-denomination-designating controller designates two or more of the target denominations from the current denominations, and the additional-denomination-discrimination-criteria-calculating controller uses one of the target denomination standards for each of the two or more of the target denominations for calculating the discrimination criteria for the additional denomination.

15. The system according to claim 12, wherein in a case where it is required to set the discrimination criteria for two or more of the additional denominations at one time, the additional-denomination-discrimination-criteria-calculating controller switchably designates two or more of the target denominations when calculating the discrimination criteria for each of the two or more of the additional denominations.

16. The system according to claim 12, wherein a single software component of the system
(a) stores the target denomination standards and the additional denomination standards in the coin discrimination apparatus using the target denomination which is designated in advance,
(b) calculates the discrimination criteria for the additional denomination by multiplying the ratios by the discrimination criteria for the target denomination,
(c) stores the calculated discrimination criteria for the additional denomination in the discrimination criteria storing device, and
(d) sets the coin discrimination apparatus to conduct authentication discrimination and denomination discrimination using the calculated discrimination criteria for the additional denomination.

17. The system according to claim 12, wherein:

the discrimination criteria for the target denomination are given by amplitudes of a first set of waveforms that vary according to the sensor information;

the discrimination criteria for the additional denomination are given by amplitudes of a second set of waveforms that vary according to the sensor information;

the target denomination standards are given by amplitudes of a third set of waveforms that vary according to the sensor information;

the additional denomination standards are given by amplitudes of a fourth set of waveforms that vary according to the sensor information pieces; and a relationship between the amplitudes that give the discrimination criteria for the target denomination and the amplitudes that give the discrimination criteria for the additional denomination is given by a relationship between the target denomination standards and the additional denomination standards.

18. The system according to claim 12, wherein the discrimination criteria for the additional denomination include information relating to a material of the coins, information relating to a thickness of the coins, and information relating to a diameter of the coins; and when the information relating to the diameter of the coins is calculated, the target-denomination-designating controller designates one of the current denominations that has a nearest diameter to the additional denomination as the target denomination.

19. A non-transitory computer readable medium storing a program for setting discrimination criteria for an additional denomination not currently stored in a coin discrimination apparatus that conducts authenticity discrimination and denomination discrimination of coins using sensor information outputted from coin sensors in addition to discrimination criteria for each of current denominations in the coin discrimination apparatus, which comprises processes to be executed by a computer, the processes comprising:

determining whether the discrimination criteria for the additional denomination are stored in a discrimination criterion information storing device of the coin discrimination apparatus in which the discrimination criteria for each of the current denominations are stored;

designating a target denomination from the current denominations when it is determined that the discrimination criteria for the additional denomination are not stored;

calculating the discrimination criteria for the additional denomination by multiplying discrimination criteria for the target denomination by ratios between target denomination standards to be complied with by discrimination criteria for the target denomination when setting the discrimination criteria for the current denomination designated as the target denomination using a standard apparatus for setting the target denomination standards for the coin discrimination apparatus by its manufacturer, and obtained by conducting the authenticity discrimination and denomination discrimination of coins having the target denomination using the standard apparatus, and additional denomination standards to be complied with by discrimination criteria for the additional denomination when setting the discrimination criteria for the additional denomination using the standard apparatus for setting the additional denomination standards for the coin discrimination apparatus by its manufacturer, and obtained by conducting the authenticity discrimination and denomination discrimination of coins having the additional denomination using the standard apparatus;

storing the calculated discrimination criteria for the additional denomination in the discrimination criterion information storing device;

setting the coin discrimination apparatus to conduct authentication discrimination and denomination discrimination using the calculated discrimination criteria for the additional denomination, wherein when the discrimination criteria for the additional denomination are calculated by multiplying the ratios by the discrimination criteria for the target denomination, two or more calculation methods are selectively used, each of the two or more calculation methods obtains the discrimination criteria for the additional denomination by applying predetermined parameters to a predetermined equation, and one of the two or more calculation methods is selectively used to reduce an effect of a fluctuation of the coin discrimination performance of the coin discrimination apparatus from the coin discrimination performance of the standard apparatus;

switching the coin discrimination apparatus from a normal mode in which the coin discrimination apparatus performs coin discriminating operations for discriminating the authenticity and denomination of a coin from discrimination criteria for the current denominations, to a new denomination adding mode for determining whether the additional-denomination discrimination criteria are stored in the coin discrimination apparatus and for calculating the additional-denomination discrimination criteria in the event the additional-denomination discrimination criteria are not stored in the coin discrimination apparatus by performing the determining, designating, calculating, storing, and setting operations; and automatically switching the coin discrimination apparatus from the new denomination adding mode to the normal mode when the operations performed in the new denomination adding mode are completed, wherein the target denomination is designated by selecting the current denomination that produces the smallest difference when calculating the difference between a specific information piece or a value that is extracted from the output signal waveform of each current denomination from a respective coin sensor of the coin sensors and a specific information piece or a corresponding value that is extracted from the output signal waveform of the additional denomination from a corresponding coin sensor of the coin sensors.

20. The medium according to claim 19, wherein it is determined whether or not two or more of the target denominations can be designated from the current denominations, and when two or more of the target denominations can be designated from the current denominations, the two or more of the target denominations are selectively used in such a way that differences in value between one of the target denomination standards for each of the two or more of the target denominations and a corresponding one of the additional denomination standards are as small as possible.

21. The medium according to claim 19, wherein two or more of the target denominations are designated from the current denominations, and one of the target denomination standards for each of the two or more of the target denominations is used for calculating the discrimination criteria for the additional denomination.

22. The medium according to claim 19, wherein in a case where it is required to set the discrimination criteria for two or more of the additional denominations at one time, two or more of the target denominations are switchably designated when calculating the discrimination criteria for each of the two or more of the additional denominations.

23. The medium according to claim 19, wherein a single software component of the program (a) stores the target denomination standards and the additional denomination standards in the coin discrimination apparatus using the target denomination which is designated in advance, (b) calculates the discrimination criteria for the additional denomination by multiplying the ratios by the discrimination criteria for the target denomination, (c) stores the calculated discrimination criteria for the additional denomination in the discrimination criteria-storing device, and (d) sets the coin discrimination apparatus to conduct authentication discrimination and denomination discrimination using the calculated discrimination criteria for the additional denomination.

24. The medium according to claim 19, wherein the discrimination criteria for the target denomination are given by amplitudes of a first set of waveforms that vary according to the sensor information;

the discrimination criteria for the additional denomination are given by amplitudes of a second set of waveforms that vary according to the sensor information;

the target denomination standards are given by amplitudes of a third set of waveforms that vary according to the sensor information;

the additional denomination standards are given by amplitudes of a fourth set of waveforms that vary according to the sensor information; and a relationship between the amplitudes that give the discrimination criteria for the target denomination and the amplitudes that give the discrimination criteria for the additional denomination is given by a relationship between the target denomination standards and the additional denomination standards.

25. The medium according to claim 19, wherein the discrimination criteria for the additional denomination include information-relating to a material of the coins, information relating to a thickness of the coins, and information relating to a diameter of the coins; and when the information relating to the diameter of the coins is calculated, one of the current denominations that has a nearest diameter to the additional denomination is designated as the target denomination.

* * * * *